US006454391B1

(12) United States Patent
Kobayashi et al.

(10) Patent No.: US 6,454,391 B1
(45) Date of Patent: Sep. 24, 2002

(54) MULTI-NOZZLE INK JET RECORDING DEVICE INCLUDING COMMON ELECTRODES FOR GENERATING DEFLECTOR ELECTRIC FIELD

(75) Inventors: Shinya Kobayashi; Takahiro Yamada; Hitoshi Kida; Kunio Satou; Katsunori Kawasumi; Kazuo Shimizu, all of Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/915,504

(22) Filed: Jul. 27, 2001

(30) Foreign Application Priority Data

Jul. 28, 2000 (JP) ..... 2000-228127

(51) Int. Cl.[7] ..... B41J 29/38; B41J 2/145; B41J 2/05

(52) U.S. Cl. ..... 347/41

(58) Field of Search ..... 347/41, 73, 44, 347/14, 19

(56) References Cited

U.S. PATENT DOCUMENTS 5,422,666 A * 6/1995 Koyama ..... 347/41
5,801,732 A * 9/1998 Pengelly ..... 347/70
6,099,108 A * 8/2000 Weber et al. ..... 347/43

FOREIGN PATENT DOCUMENTS

JP 47-7847 3/1972

* cited by examiner

*Primary Examiner*—Thinh Nguyen
(74) *Attorney, Agent, or Firm*—Whitham, Curtis & Christofferson, P.C.

(57) ABSTRACT

An ink jet recording device 1 includes electrodes 401, 402 for generating charging and deflector electric fields E1, E2 common to all nozzles 107*a*. The ink jet recording device 1 also includes means for controlling the charging electric field pattern and ink-droplet ejection interval. Accordingly, ejected ink droplets 501 are controlled to impact on grid corners 704*a* of grids 704 defined by x-y coordinate system.

21 Claims, 16 Drawing Sheets

| ELECTRIC VOLTAGE Vchg (V) | DEFLECTION AMOUNT c (μm) | AVERAGE SPEED Vav (m/sec) |
|---|---|---|
| 200 | 187 | 2.45 |
| 100 | 94 | 2.49 |
| 0 | 0 | 2.46 |
| -100 | -94 | 2.38 |
| -200 | -187 | 2.42 |

FIG.8(a)
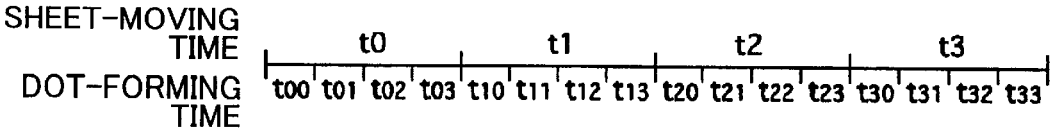
FIG.8(b)
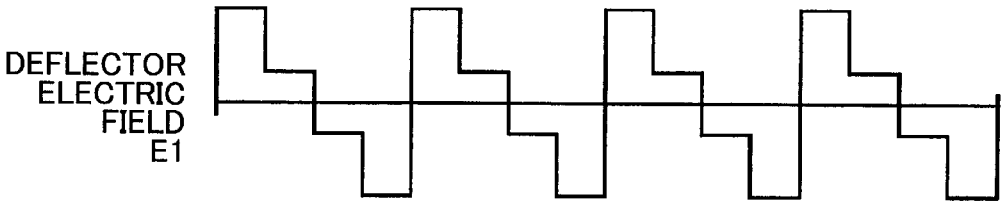
FIG.8(c)
EJECTION DATA 112
| | | | | | | | | | | | | | | | | |
|---|---|---|---|---|---|---|---|---|---|---|---|---|---|---|---|---|
| x | 3 | 2 | 1 | 0 | 3 | 2 | 1 | 0 | 3 | 2 | 1 | 0 | 3 | 2 | 1 | 0 |
| y | 0 | 0 | 0 | 0 | 1 | 1 | 1 | 1 | 2 | 2 | 2 | 2 | 3 | 3 | 3 | 3 |
FIG.8(d) FIG.8(e) FIG.8(f) FIG.8(g)
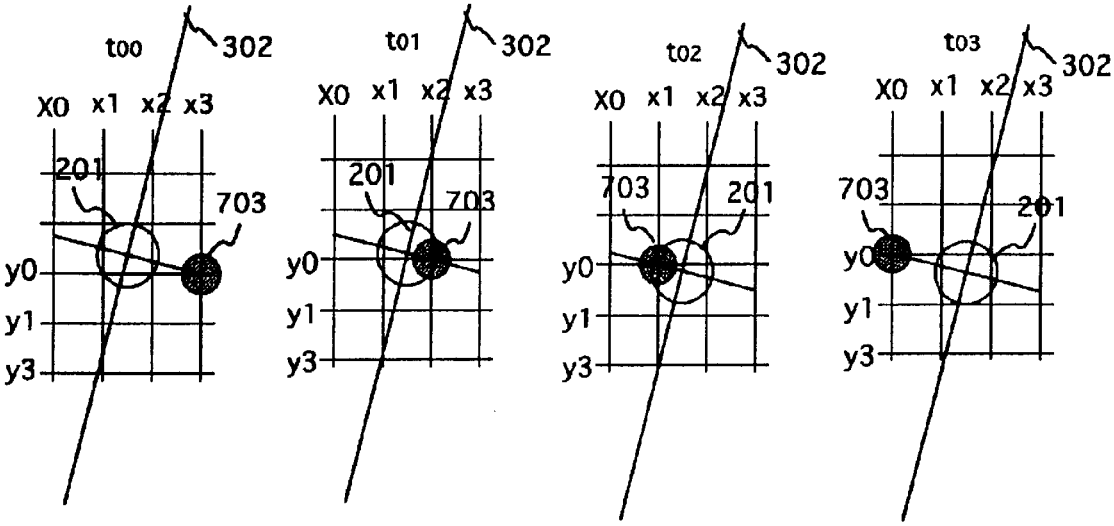

P(dx,0), r=1, AND n=kx n = 2, kx = 2, ky = 4 tan θ = -1/2

P(dx,0), r=1, AND n=kx n = 3, kx = 3, ky = 1 tan θ = -1/3

P(dx,0), r=1, AND n=kx n = 4, kx = 4, ky = 1 tan θ = -1/4

P(dx,0), tan $\theta$ =1, AND n=kx n = 2, r =2, kx = 2, ky = 1

P(dx,0), tan $\theta$ =1, AND n=kx n = 3, r =3, kx = 3, ky = 1

P(dx,0), tan $\theta$ =1, AND n=kx n = 4, r =4, kx = 4, ky = 1

P(dx,0), tan $\theta$ =1, AND n=kx n = 5, r =5, kx = 5, ky = 1

P(dx,dy), tan $\theta$ =1, AND n=kx n = 2, r =2, kx = 2, ky = 1

P(dx,dy), tan $\theta$ =1, AND n=kx n = 3, r =1.5, kx = 3, ky = 2

P(dx,dy), tan $\theta$ =1, AND n=kx n = 4, r =4/3, kx = 4, ky = 3

P(dx,dy), tan $\theta$ =1, AND n=kx n = 5, r =1.25, kx = 5, ky = 4

P(dx,2·dy), tan $\theta$ =1, AND n=kx n = 2, r =2/3, kx = 2, ky = 3

P(dx,2·dy), tan $\theta$ =1, AND n=kx n = 4, r =4/7, kx = 4, ky = 7

P(dx,2·dy), tan $\theta$ =1, AND n=kx n = 3, r =3/5, kx = 3, ky = 5

P(dx,2·dy), tan $\theta$ =1, AND n=kx n = 5, r =5/9, kx = 5, ky = 9

P(2·dx, 1·dy), tan $\theta$ =1, AND n=kx n = 3, r =3, kx = 3, ky = 1

P(2·dx, 3·dy), tan $\theta$ =1, AND n=kx n = 3, r =3/4, kx = 3, ky = 4

P(3·dx, 1·dy), tan $\theta$ =1, AND n=kx n = 4, r =4, kx = 4, ky = 1

P(3·dx, 2·dy), tan $\theta$ =1, AND n=kx n = 2, r =2, kx = 2, ky = 1

P(3·dx, 2·dy), tan $\theta$ =1, AND n=kx n = 5, r =5/3, kx = 5, ky = 3

P(dx,0), n=4, r=2, AND tan $\theta$ =1/2 kx=4, ky=4, NO-MULTIPLE EJECTION

P(dx,0), n=4, r=2, AND tan $\theta$ =1/2 kx=3, ky=3,
PARTIALLY-DOUBLE-EJECTION

P(dx,0), n=4, r=2, AND tan $\theta$ =1/2 kx=2, ky=2,
ALL-DOUBLE-EJECTION

P(dx,0), n=4, r=2, AND tan $\theta$ =1/2 kx=1, ky=1,
ALL-QUADRUPLE-EJECTION

P(dx, 0.5·dy) AND n=4 r=4, kx=4, ky=1, tan $\theta$ =1
NO-MULTIPLE-EJECTION

P(dx, 0.5·dy) AND n=4 r=4, kx=2, ky=1/2, tan $\theta$ =1
ALL-DOUBLE-EJECTION

P(dx, 0.5·dy) AND n=4 r=2, kx=4, ky=1, tan $\theta$ =1/2
NO-MULTIPLE-EJECTION

P(dx, 0.5·dy) AND n=4 r=2, kx=2, ky=1/2, tan $\theta$ =1/2
ALL-QUADRULE-EJECTION

MULTI-NOZZLE INK JET RECORDING DEVICE INCLUDING COMMON ELECTRODES FOR GENERATING DEFLECTOR ELECTRIC FIELD

BACKGROUND OF THE INVENTION

1. Field of the Invention

The present invention relates to a multi-nozzle ink jet recording device and a recording method for reliably forming high-quality images by deflecting ejected ink droplets using a charging electric field and a deflector electric field.

2. Description of the Related Art

Japanese Patent Publication No. SHO-47-7847 discloses a conventional ink jet recording device that forms images on a recording sheet. The device is formed with a plurality of nozzles aligned in a line in a widthwise direction of the recording sheet. Ink droplets are ejected from the nozzles and impact on the recording sheet and form dots thereon while the recording sheet is moved in a sheet feed direction perpendicular to the widthwise direction. The ejected ink droplets are uniform in their size and each is separated from the other.

The recording device also includes electrodes that generate a charging electric field and a deflector electric field. The charging electric field charges the ejected ink droplets based on a recording signal, and the deflector electric field having a uniform magnitude changes a flying direction of the charged ink droplets along the widthwise direction as needed, thereby controlling the impact positions of the ink droplets with respect to the widthwise direction and forms the dots on exact target positions. The target portions are usually determined by a coordinate system defined on the recording sheet.

There has been also proposed a nozzle array where a plurality of nozzles are formed in an arrayed manner, which improves recording speed. Also, there has been increased demand for obtaining higher-resolution images. Increasing the resolution of images requires a smaller distance between adjacent two nozzles so as to obtain a sufficiently high nozzle density. However, it is difficult to provide electrodes for generating the charging electric field for each of the plurality of nozzles arranged in such a high nozzle density because of the structural reasons.

SUMMARY OF THE INVENTION

In order to overcome the above problems, it is conceivable to form electrodes with a simple straight shape common to all of the plurality of nozzles. Such common electrodes would realize a high nozzle density, reduce manufacturing cost of the ink-jet recording device, and improve reliability thereof.

However, there are following problems in providing the common electrodes.

First, because the nozzle line extends in the widthwise direction as described above, the common electrodes need to extend in the widthwise direction also in order to change the flying direction of the ink droplets. However, in this case, the flying direction of the ink droplets will be changed along the sheet feed direction, rather than the widthwise direction. There is no advantage or reason to change the flying direction along the sheet feed direction in this type of recording device.

On the other hand, when the nozzle line is arranged to extend in the sheet feed direction rather than the width wise direction, common electrodes extending in the sheet feed direction will change the flying direction along the widthwise direction. However, images cannot be formed in this arrangement.

Therefore, both the nozzle line and the common electrodes are required to extend angled with respect to the widthwise direction without being parallel with the sheet feed direction.

However, when the nozzle line is angled in this manner, a position of each nozzle changes from its original position with respect to both the sheet feed direction and the widthwise directions, and so the impact position of the ink droplet also changes. As a result, the impact position will shift from the target position defined by the coordinate system, and positional error occurs.

In addition, because the common electrodes also are angled with respect to the widthwise direction so as to extend parallel with the nozzle line, the deflect direction of the ink droplet is angled with respect to the widthwise direction. If it is possible to individually control the deflection amount and ejection timing of ink droplets from each nozzle, it may be possible to adjust such a positional error. However, when the common electrodes are used, the deflection amount and ejection timing are common to all nozzles, so that it is difficult to control all ink droplets to impact on exact target positions.

It is therefore an objective of the present invention to overcome the above-described problems and also to provide a multi-nozzle ink-jet recording device having a charging electrode and deflector electrode, which are common for all nozzles, and capable of controlling ink droplets ejected from the nozzles to accurately hit on target impact positions in a recording coordinate with a predetermined resolution, and also to provide a recording method thereof.

In order to achieve the above and other objectives, there is provided a multi-nozzle ink jet recording device including a print head, ejection means, a pair of electrodes, generating means, and control means. The print head is formed with an orifice line extending in a line direction and including a plurality of orifices aligned at a uniform pitch. The ejection means ejects ink droplets through the plurality of orifices. The ink droplets have a uniform shape and being separated from one another. The pair of electrodes are common to all the plurality of orifices. The generating means generates a charging electric field and a deflecting electric field at the same time by applying a voltage to the pair of electrodes. The charging electric field is generated near the orifices, has a magnitude that changes at an ink-ejection frequency, and charges the ink droplets. The deflecting electric field has a constant magnitude and deflects a flying direction of the ink droplets. The controlling means controls the ejection means to eject the ink droplets at a uniform ejection interval onto all grid corners of grids in a coordinate system defined on a recording medium having a width in a widthwise direction and a length in a lengthwise direction perpendicular to the widthwise direction.

There is also provided a multi-nozzle ink jet recording device including a print head, ejection means, a pair of electrodes, applying means, and controlling means. The print head is formed with an orifice line extending in a line direction and including a plurality of orifices aligned at a uniform orifice pitch. The ejection means ejects ink droplets through the plurality of orifices at an ink-ejection frequency onto a recording medium having a width in a widthwise direction and a length in a lengthwise direction perpendicular to the widthwise direction. The line direction has an angle $\theta$ with respect to the lengthwise direction. The pair of electrodes are common to all the plurality of orifices and extending in the line direction while interposing the orifice line therebetween in plan view. The applying means applies a voltage to the pair of electrodes. The pair of electrodes generate a charging electric field and a deflecting electric field between the electrodes when applied with the voltage. The charging electric field has a magnitude that changes at the ink-ejection frequency and charges the ink droplets. The deflecting electric field has a constant magnitude and deflecting a flying direction of the ink droplets charged by the charging electric field. The controlling means controls the voltage applied to the electrodes such that the ink droplets deflected by the deflecting electric field impact on all grid corners of grids in a coordinate system defined on the recording medium, and that ink droplets ejected through a single one of the plurality of orifices and deflected by the deflecting electric field impact on one of n scanning lines extending in the lengthwise direction.

Further, there is provided a printing method using a multi-nozzle ink jet recording device including components. The components includes a print head formed with a orifice line extending in a line direction and including a plurality of orifices; ejection means for ejecting ink droplets through the plurality of orifices, the ink droplets having a uniform shape and separated from one another; a pair of electrodes common to all the plurality of orifices; and generating means for generating a charging electric field and a deflecting electric field at the same time by applying a voltage to the pair of electrodes, the charging electric field being generated near the orifices and having a magnitude that changes at an ink-ejection frequency and charging the ink droplets, the deflecting electric field having a constant magnitude and deflecting a flying direction of the ink droplets. The method includes the step of controlling the components to eject the ink droplets at a uniform ink-ejection frequency onto all grid corners of a rectangular coordinate system defined on a recording medium.

There is also provided a printing method using a multi-nozzle ink jet recording device including components that includes: a print head formed with a orifice line extending in a line direction and including a plurality of orifices aligned at a uniform orifice pitch; ejection means for ejecting ink droplets through the plurality of orifices, the ink droplets having a uniform shape and separated from one another; a pair of electrodes common to all the plurality of orifices; and generating means for generating a charging electric field and a deflecting electric field at the same time by applying a voltage to the pair of electrodes, the charging electric field being generated near the orifices and having a magnitude that changes at an ink-ejection frequency and charging the ink droplets, the deflecting electric field having a constant magnitude and deflecting a flying direction of the ink droplets. The method includes the step of controlling the components to eject the ink droplets at a uniform ink-ejection frequency onto all grid corners of a non-rectangular coordinate system defined on a honeycomb-shaped recording medium.

BRIEF DESCRIPTION OF THE DRAWINGS

The above and other objects, features and advantages of the present invention will become more apparent from the following description when taken in conjunction with the accompanying drawings, in which:

FIG. 3(*b*) is a plan view showing the ejection surface of the recording head;

FIG. 8(*a*) is an explanatory view showing a dot frequency and a deflected-dot frequency;

FIG. 8(*b*) is an explanatory view showing change in magnitude of a deflector electric field;

FIG. 8(*c*) is an explanatory view showing ejection data;

FIG. 8(*d*) is an explanatory view showing a positional relationship between an orifice and an impact position of a deflected ink droplet;

FIG. 8(*e*) is an explanatory view showing a positional relationship between an orifice and an impact position of a deflected ink droplet;

FIG. 8(*f*) is an explanatory view showing a positional relationship between an orifice and an impact position of a deflected ink droplet;

FIG. 8(*g*) is an explanatory view showing a positional relationship between an orifice and an impact position of a deflected ink droplet;

FIG. 12(*b*) is an explanatory view of another example of printing operation;

FIG. 12(*c*) is an explanatory view of another example of printing operation;

FIG. 13(*b*) is an explanatory view of another example of printing operation;

FIG. 13(*c*) is an explanatory view of another example of printing operation;

FIG. 13(*d*) is an explanatory view of another example of printing operation;

FIG. 14(*b*) is an explanatory view of another example of printing operation;

FIG. 14(*c*) is an explanatory view of another example of printing operation;

FIG. 14(*d*) is an explanatory view of another example of printing operation;

FIG. 15(*b*) is an explanatory view of another example of printing operation;

FIG. 15(*c*) is an explanatory view of another example of printing operation;

FIG. 15(*d*) is an explanatory view of another example of printing operation;

FIG. 19(*b*) is an explanatory view of another example of printing operation;

FIG. 20(*b*) is an explanatory view of another example of printing operation;

FIG. 20(*c*) is an explanatory view of another example of printing operation;

FIG. 20(*d*) is an explanatory view of another example of printing operation;

FIG. 21(*b*) is an explanatory view of another example of printing operation;

FIG. 21(*c*) is an explanatory view of another example of printing operation; and FIG. 21(*d*) is an explanatory view of another example of printing operation.

PREFERRED EMBODIMENT OF THE PRESENT INVENTION

Next, a line-scanning-type multi-nozzle ink jet recording device and a recording method according to an embodiment of the present invention will be described while referring to the accompanying drawings.

First, overall configuration of the line-scanning-type multi-nozzle ink jet recording device 1 will be described while referring to FIGS. 1 to 8.

Figure 1:
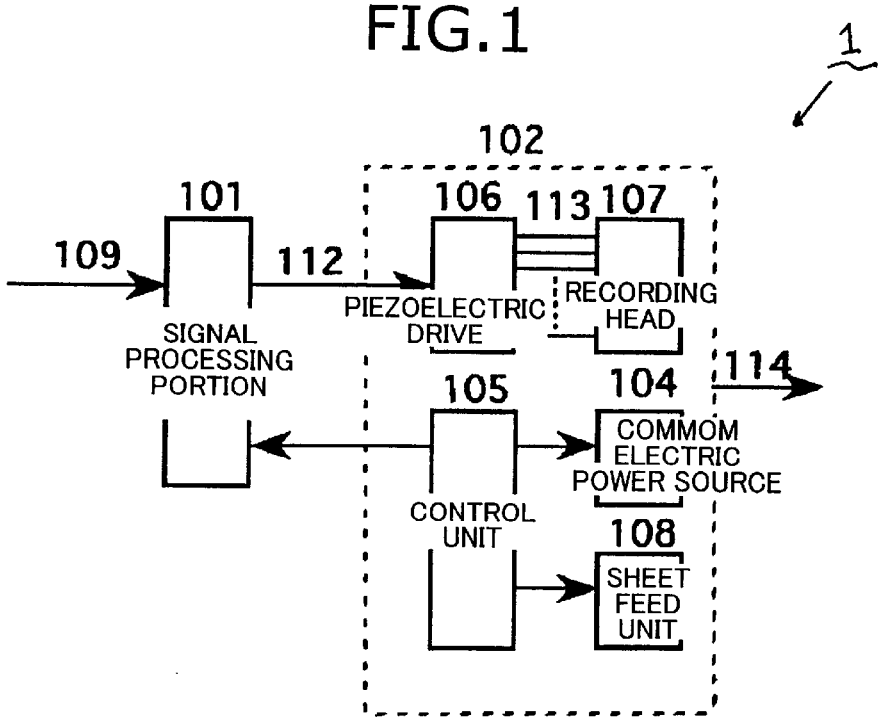
FIG. 1 is a block diagram of components of an ink jet recording device according to an embodiment of the present invention.
Figure 2:
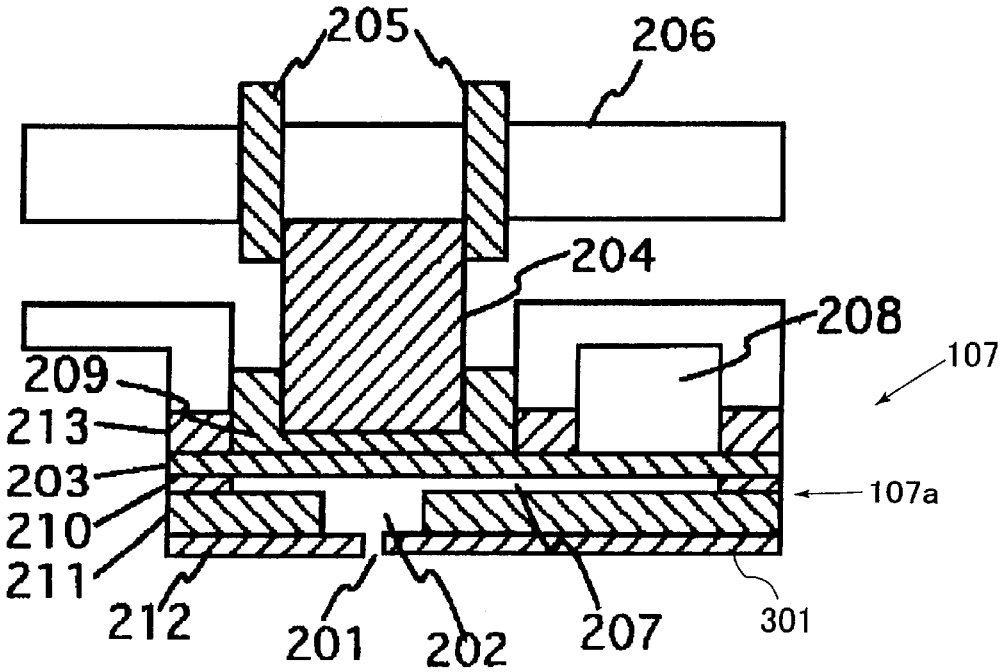
FIG. 2 is a cross-sectional view of a nozzle formed to a recording head of the ink jet recording device.

As shown in FIG. 1, the ink jet recording device 1 includes a signal processing portion 101 and an engine portion 102.The engine portion 102 includes a control unit by 105, a piezoelectric driver 106, a recording head 107, a common electrode power source 104, and a sheet feed unit 108. The recording head 107is formed with a plurality of nozzles 107*a* (FIG. 2). Because the piezoelectric driver 106 has a well-known configuration, detailed description thereof will be omitted.

When the ink jet recording device 1is a full-color recording device, a plurality of recording heads 107 are provided for a plurality of different colored ink. However, in the present embodiment, it is assumed that the ink jet recording device 1 is a monochromatic recording device, and that only one recording head 107 is provided.

The signal processing portion 101 receives a bitmap data 109, which is binary data, from an external computer and the like (not shown). When the ink jet recording device 1 is the full-color recording device, a plurality of sets of the bitmap data 109 are usually provided for the recording heads 107.

Upon receipt of the bitmap data 109, the signal processing portion 101 generates ejection data 112 for each of the nozzles 107*a* of the recording head 107 based on the bitmap data 109. The ejection data 112 is arranged, based on position information of each nozzle 107*a* and deflection information of ink droplets, in an order in which ink droplets are ejected. The signal processing portion 101 temporarily stores one-scanning-worth or one-page-worth of the ejection data 112.

The control unit 105 of the engine portion 102 controls the sheet feed unit 108 and the common electrode power source 104.When printing is started, the sheet feed unit 108 starts feeding a recording sheet. At the same time, the common electrode power source 104 applies an electric voltage to common electrodes 401, 402 (FIGS. 4 and 5) to be described later, thereby generating a charging electric field and a deflector electric field. When a recording position of the recording sheet reaches the recording head 107, the control unit 105 outputs a request command to the signal processing portion 101, the request command requesting the signal processing portion 101 to output the ejection data 112 . The ejection data 112 is input to the piezoelectric driver 106, and the piezoelectric driver 106 outputs a print signal 113 to each nozzle 107*a* of the recording head 107. As a result, an image 114 is formed on the recording sheet.

In the ink jet recording device 1 of the present embodiment, printing is performed by the recording head 107 that is held still while the recording sheet is transported.

As shown in FIG. 2, each nozzle 107*a* of the recording head 107 includes a diaphragm 203, a piezoelectric element 204, a signal input terminal 205, a piezoelectric element supporting substrate 206, a restrictor plate 210, a pressure-chamber plate 211, an orifice plate 212, and a supporting plate 213. The diaphragm 203 and the piezoelectric element 204 are attached to each other by a resilient member 209, such as a silicon adhesive. The restrictor plate 210 defines a restrictor 207. The pressure-chamber plate 211 and the orifice plate 212 define a pressure chamber 202 and an orifice 201, respectively. The orifice plate 212 has an ejection surface 301. A common ink supply path 208 is formed above the pressure chamber 202 and is fluidly connected to the pressure chamber 202 via the restrictor 207. Ink flows from above to below through the common ink supply channel 208, the restrictor 207, the pressure chamber 202, and the orifice 201. The restrictor 207 regulates an ink amount supplied into the pressure chamber 202. The supporting plate 213 supports the diaphragm 203. The piezoelectric element 204 deforms when a voltage is applied to the signal input terminal 205, and maintains its initial shape when no voltage is applied.

The diaphragm 203, the restrictor plate 210, the pressure-chamber plate 211, and the supporting plate 213 are formed from stainless steel, for example. The orifice plate 212 is formed from nickel material. The piezoelectric element supporting substrate 206 is formed from an insulating material, such as ceramics and polyimide.

The print signal 113 output from the piezoelectric driver 106is input to the signal input terminal 205. In accordance with the print signal 113, uniform ink droplets separated from each other are ejected, ideally outwardly with respect to a normal line of the orifice plate 212, from the orifice 201.

Figure 3A:
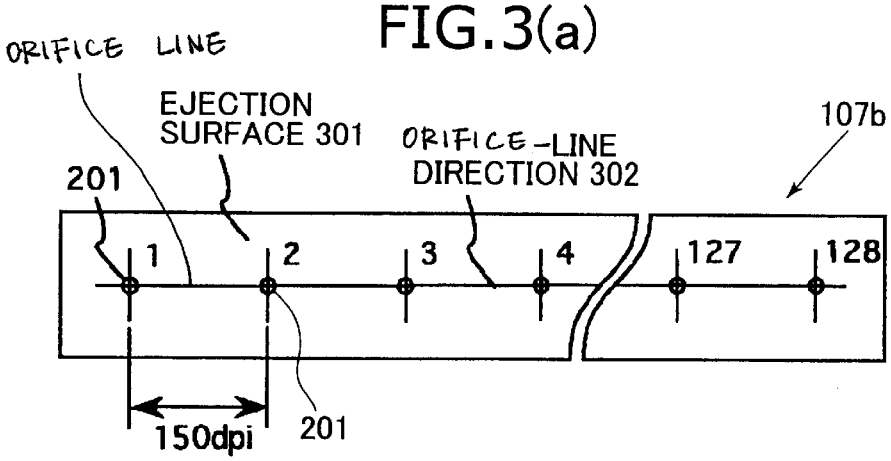
FIG. 3(*a*) is a plan view partially showing an ejection surface of the recording head.
Figure 3B:
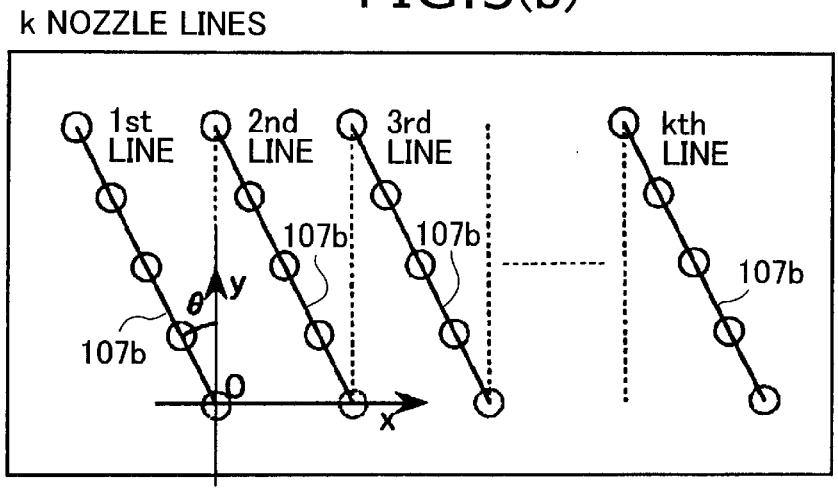

As shown in FIG. 3(*b*), a plurality of orifice lines 107*b* are formed to the recording head 107. Details will be described below.

As shown in FIG. 3(*b*), the ejection surface 301 is formed with a plurality of the orifice lines 107*b* arranged side by side in an x direction and each extending in an orifice-line direction 302, which is inclined by θ with respect to a y direction perpendicular to the x direction. As shown in FIG.

3(*a*), each orifice line 107*b* includes 128 orifices 201 arranged at a pitch of 75 orifices/inch in the orifice-line direction 302. Although not indicated in the drawings, adjacent orifice lines 107*b* are usually overlap each other in the x direction by several-dot-worth amount. This arrangement prevents unevenness in color density of recorded image, which appears in a black or white band, due to erroneous attachment and uneven nozzle characteristics, and also enables assembly of a recording head elongated in the x direction.

Figure 4:
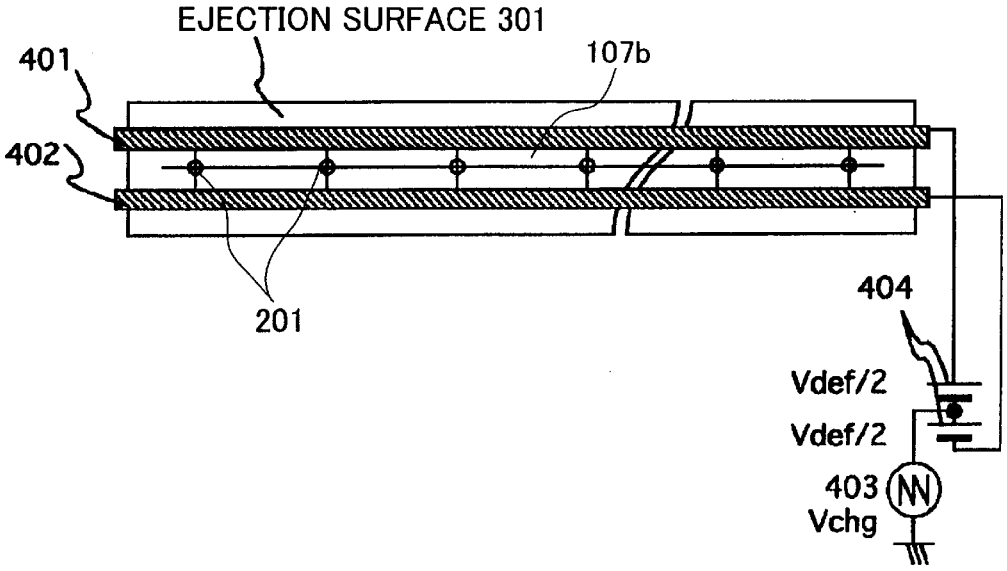
FIG. 4 is an explanatory plan view showing the ejection surface and common electrodes.
Figures 5, 6:
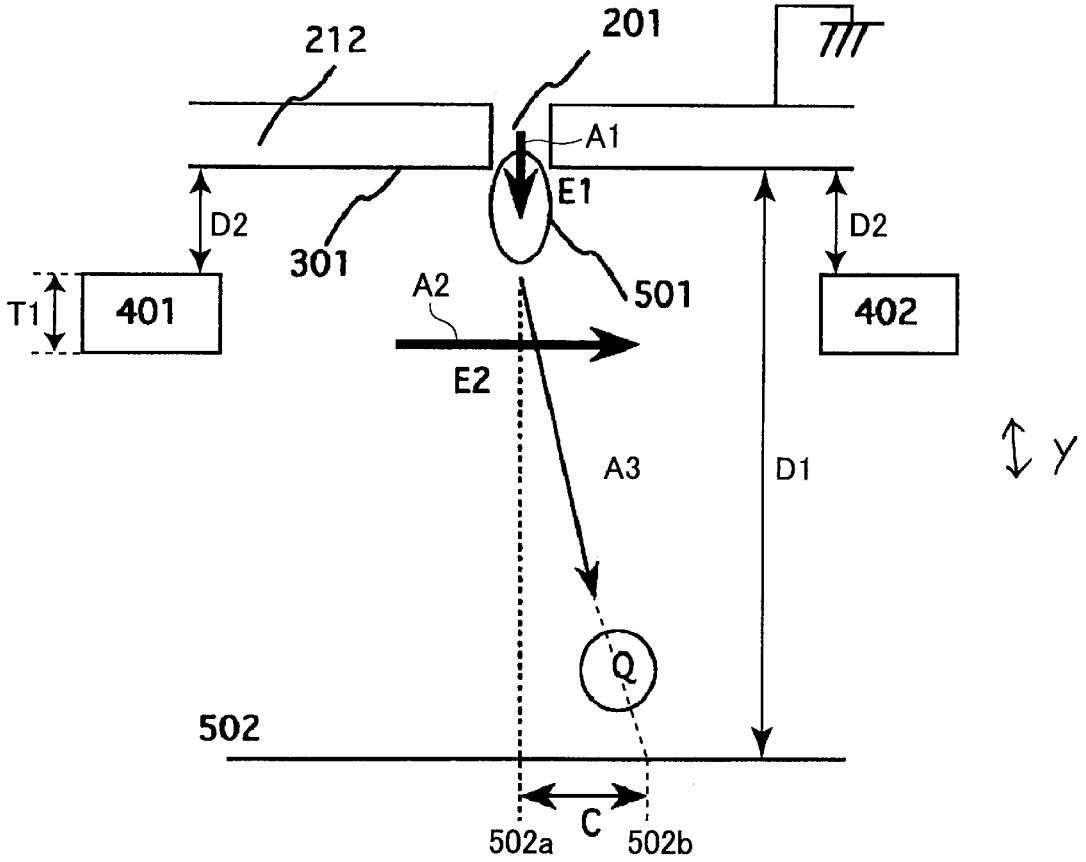
FIG. 5 is an explanatory cross-sectional view showing ink droplet deflection.
FIG. 6 is a table indicating deflection results.

As shown in FIGS. 4 and 5, the common electrodes 401, 402 are provided for each orifice line 107*b*, at positions between the ejection surface 301 and a recording sheet 502. The common electrodes 401, 402 extend parallel to and sandwich the corresponding orifice line 107*b* in a plan view. In the present embodiment, a distance D1 from the orifice plate 212 to the recording sheet 502 is 1.6 mm. A distance D2 from the orifice plate 212 to the common electrode 401 (402) is 0.3 mm. Each common electrode 401, 402 has a thickness T1 of 0.3 mm in the y direction. The common electrodes 401 and 402 are separated from each other by a distance of 1 mm.

As shown in FIG. 3, there are provided an alternate current (AC) power source 403 and a pair of direct current (DC) power sources 404. The AC power source 403 outputs an electric voltage Vchg. As will be described later, the value of the electric voltage Vchg is changed among several different values in a predetermined frequency. Each of the DC power sources 404 outputs an electric voltage Vdef/2. With this configuration, an electric voltage of Vchg+Vdef/2 and Vchg-Vdef/2 are applied to the common electrodes 401 and 402, respectively. The orifice plate 212 having the ejection surface 301 is connected to the ground.

As shown in FIG. 5, the common electrodes 401, 402 and the orifice plate 212 together generate a charging electric field E1 in a region near the orifice 201. Because the orifice plate 212 is conductive and connected to the ground, the direction of the charging electric field E1 is parallel to the normal line of the orifice plate 212 as indicated by an arrow A1. The common electrodes 401 and 402 also generate a deflector electric field E2 having a direction from the common electrode 401 to the common electrode 402 as indicated by an arrow A2. That is, the deflector electric field E2 has the direction A2 perpendicular to the orifice-line direction 302. The magnitude of the deflector electric field E2 is in proportion to the electric voltage Vdef. The electric voltage Vdef is maintained at 400V in this embodiment.

Because the orifice 201 is separated from both the electrodes 401 and 402 by the same distance, the electric voltage applied to an ink droplet 501, which is about to be ejected, is in proportion to the electric voltage Vchg. Accordingly, at the time of when ejected from the orifice 201, the ink droplet 501is charged with a voltage of Q in a polarity opposite to the electric voltage Vchg. In this way, the electric field E1 charges the ink droplet 501.

After ejection, the flying speed of the ink droplet 501 is accelerated by the charging electric field E1. When the ink droplet 501 reaches between the common electrodes 401 and 402, the deflector electric field E2 deflects the ink droplet 501 toward the direction A2 of the electric field E2 and changes its flying direction to a direction indicated by an arrow A3. Then, the ink droplet 501 impacts on the recording sheet 502 at a position 502*b* shifted in the direction A2 by a distance C from an original position 502*a* where the ink droplet 501 would have impacted if not deflected at all. The distance C between the actual impact position 502*b* and the original position 502*a* is referred to as deflection amount C hereinafter.

FIG. 6 shows a table indicating the relationships among the deflection amounts C ($\mu$m) and average flying speeds Vav (m/sec) obtained when the DC voltage Vchg are 200V, 100V, 0V, −100V, and −200V. The average flying speed Vav indicates an average flying speed of the ink droplet 501 from when the ink droplet 501 is ejected from the orifice 201 until impacts on the recording sheet 502.

It should be noted that a flying time T from when the ink droplet 501 is ejected until when impacts on the recording sheet 502 is ignored in the explanation. This is because fluctuation in the deflection amount C during actual printing hardly varies the flying time T. A possible explanation for this is that when the deflection amount C is relatively large, a flying distance of the ink droplet 501 increases. However, in this case, the charging amount Q also increases, and this in turn increases acceleration rate cased by the charging electric field E1 and the deflector field E2, thereby increasing the average speed Vav of the ink droplet 501. Accordingly, the flying time T stays unchanged regardless of the deflection amount C.

Next, an x-y coordinate system used in this embodiment will be described while referring to FIG. 7. The x-y coordinate system is defined on the recording sheet 502, and includes a plurality of x-scanning lines 701 and a plurality of y-scanning lines 702. The x-scanning lines 701 extend in the x direction and align at a uniform interval of dy in the y direction, which is referred to as "resolution interval dy". On the other hand, the y-scanning lines 702 extend in the y direction and align at a uniform interval of dx in the x direction, which is referred to as "resolution interval dx". These x-scanning lines 701 and y-scanning 702 lines intersect one another and define a plurality of grids 704 having grid corners 704*a*. The ink droplets 501 are controlled to impact on one of grid corners 704*a*, which is defined by a coordinate value (dx, dy). It should be noted that in the present embodiment, the recording sheet 502 is moved in the y direction during printing.

In the present embodiment, the recording head 107 is positioned above the recording sheet 502 while its ejection surface 301 faces and extends parallel to the recording sheet 502. The distance between the recording sheet 502 and the ejection surface 301 is between 1 mm and 2 mm.

Next, a specific example of the present embodiment will be described while referring to FIG. 7. In this example, tan θ is set to ¼. Also, the charging electric field E1 takes four different magnitudes, i.e., a deflection number n is 4, so an ink droplet 501 ejected from a single is orifice 201 is deflected by one of four deflection amounts C, and impacts on one of four impact positions 703. Because it is desirable to decrease the deflection amount C, the four impact positions 703 are symmetrically arranged to the left and right sides of the orifice 201.

Also, in the present example, two adjacent orifices 201 are separated in the x direction by four grids 704 (4dx). Accordingly, the nozzle interval in the y direction is 16dx (=4dx/tan θ).

Because the orifice pitch in the orifice-line direction 302 is set to 75 orifices/inch as described above, the resolution interval dx is 20.5 $\mu$m, so the resolutions of the printed image 114 in the x and y directions are both 1,237 dpi (1/dx and 1/dy, respectively).

Although the adjacent orifices 201 are separated by 4dx in the x direction, because ink droplets 501 ejected from a single orifice 201 hit on four different x-scanning lines 701, the ink droplets 501 can form dots on all of the x-scanning lines 701.

FIGS. 8(*a*) to 8(*c*) show relationships between the charging electric field E1, the ejection data 112, and the impact positions 703. In FIG. 8(*a*), a sheet-feed time t0, t1, t2, . . . is a time duration required to move the recording sheet 502 by a single grid in the y direction (1dy), which is referred to as "dot frequency". The sheet-feed time is further divided into n dot-forming time segments t00, t01, t02, t03, t10, t11, t12, t13, t20, . . . , which is referred to as "deflected-dot frequency". In each dot-forming time segment, a single dot is formed by a single nozzle 107*a*. Because the deflection number n is 4 in this example, the dot-forming time segment is ¼ of the sheet-moving time.

The DC electric voltage Vchg applied to the common electrodes 401, 402 is changed at the deflected-dot frequency, so the magnitude of the charging electric field E1 is changed at the deflected-dot frequency in a stepped waveform as shown in FIG. 8(*b*).

As shown in FIGS. 8(*a*) and 8(*c*), the ejection data 112 is output for a dot (x3, y0) at the dot-forming time t00. As a result, as shown in FIG. 8(*d*), an ink droplet 501 ejected from the orifice 201 is deflected rightward perpendicular to the orifice-line direction 302, and impacts on a y-scanning line x3 on the recording sheet 502. At this time, the impact position 703 is on the grid corner (x3, y0).

At the subsequent dot-forming time t01, the magnitude of the charging electric field E1 has been changed as shown in FIG. 8(*b*), and the ejection data 112 for (x2, y0) is output. Accordingly, the ejected ink droplet 501 is deflected rightward and impacts on the y-scanning line x2 as shown in FIG. 8(*e*). Because the recording sheet 502 has been transported by a distance of 1dy/4 by this moment, the impact position 703 is on the grid corner (x2, y0). Then, at the dot-forming time of t02, the magnitude of the charging electric field E1 has been changed as shown in FIG. 8(*b*), and the recording sheet 502 has been moved by a distance of another 1dy/4. The ejection data 112 for (x1, y0) is output, and as shown in FIG. 8(*f*), the ejected ink droplet 501 is deflected leftward perpendicular to the orifice-line direction 302 and impacts on the grid corner (x1, y0) on the y-scanning line x1. At the dot-forming time t03, the magnitude of the charging electric field E1 has been changed as shown in FIG. 8(*b*), and the ejection data 112 for (x2, y0) is output. Accordingly, as shown in FIG. 8(*g*), the ejected ink droplet 501 is deflected leftward and impacts on the y-scanning line x0.

During the sheet-moving time t1 and on, the same processes are performed, so dots are formed on every grid corners.

It should be noted that because the flying time T is constant regardless of the deflection amount C as described above, it is unnecessary to take the flying time T (sheet transporting speed) into consideration when determining the ink ejection timing. In actual printing, the recording sheet 502 is moved by a predetermined distance in the y direction while the flying time T. Therefore, it would be only necessary to be aware that all the actual impact positions 703 would shift by a predetermined distance in the y direction. Also, the timing of changing the magnitude of the charging electric field E1 is set to the exact time of when the ink droplet 501 is generated, that is, when the ink droplet 501 is separated from remaining ink in the nozzle 107*a*. This can be achieved by setting the actual timing to a time a predetermined time duration after the ejection data 112 is output, that is, after the piezoelectric element is driven. This timing can be obtained through experiments.

Figure 7:
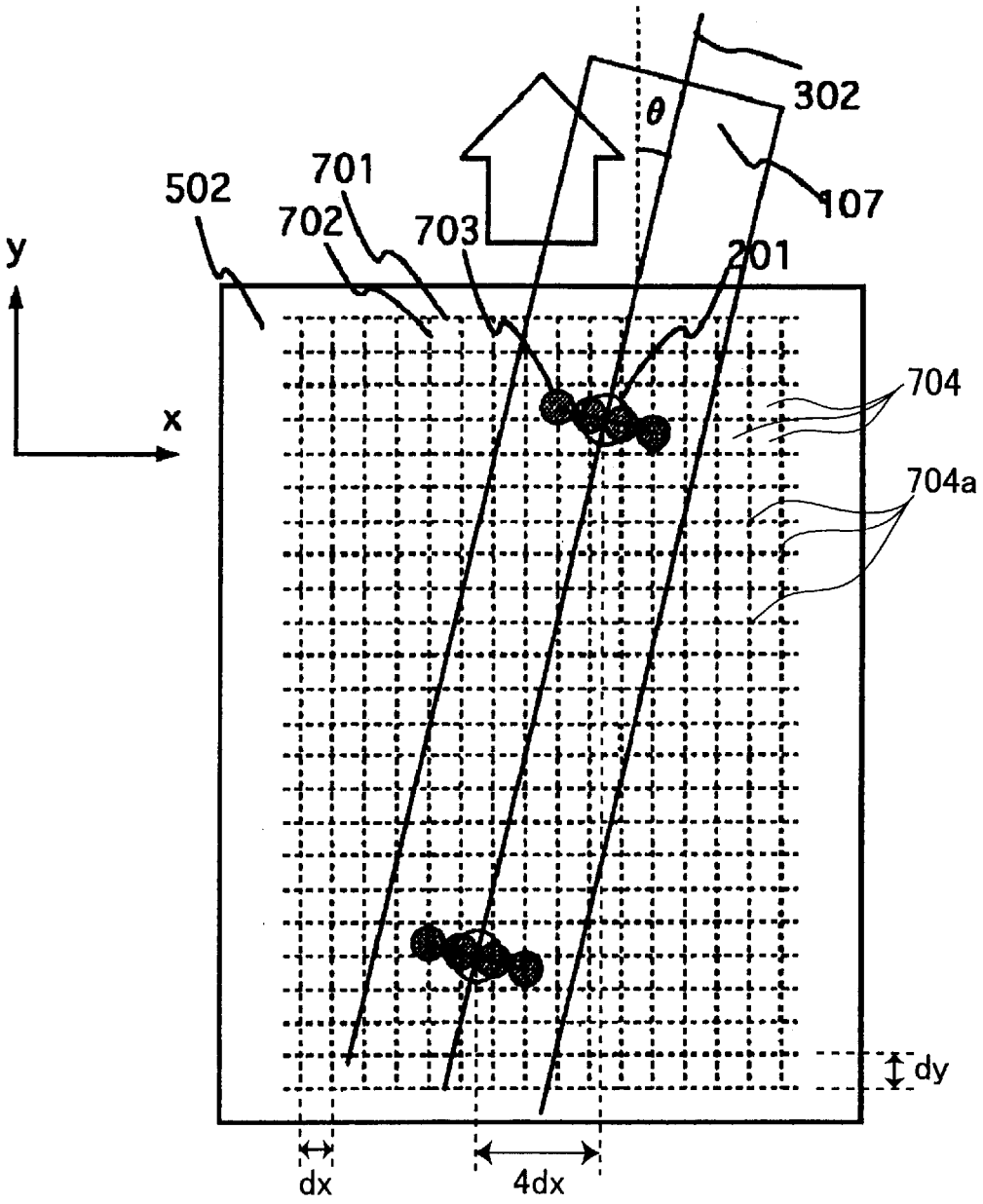
FIG. 7 is an explanatory view showing a partial configuration of engine portion including the recording head 107.

As will be understood from FIGS. 7 and 8(*d*) to 8(*g*), when the angle θ is small, required deflection amount C is small, so accuracy is increased, and the required voltage Vchg can be small. However, when the angle θ is zero, the orifice-line direction 302 is in parallel with the y direction, and so the printing becomes inoperative as described above. Also, even if the angle θ is not equal to zero, when the angle θ is insufficiently large, configuration and assembly of the recording head 107 would be difficult. Accordingly, the angle θ needs to be sufficiently large without being excessively large. In addition, there are four conditions to be met for realizing an accurate dot printing. Explanations will be provided below.

Before the explanation, terms referred to in the following explanation will be defined.

dx: resolution interval in the x direction (>0)

dy: resolution interval in the y direction (>0)

r: grid squareness rate r (dy/dx) (>0) indicating a squareness of the grids 704.

Usually, the grid squareness rate r equals 1. However, in the following explanation, the grid squareness rate r takes values other than 1. This is for when a plurality of recording heads 107 are used.

θ: inclination of the orifice-line direction 302 with respect to the y direction in a counter-clockwise direction ($0<\theta<\pi/2$)

Because of symmetry in right and left and above and below, only the condition of ($0<\theta<\pi/2$) needs satisfied.

n: (>=2)

kx·dx: orifice interval with respect to the x direction (kx=1, 2, . . . =<n)

Usually, kx equals deflection number n (kx=n). However, in the following explanation, kx takes a value smaller than the deflection number n also (kx<n) . This is for multiple ejection where ink droplets 501 from a plurality of orifices 201 impact on a single grid corner 704*a* and form a single dot thereon.

ky·dy: orifice interval with respect to the y direction

Next, the relationships between the ejection timing, the ejection position, and the impact position will be described in more detail.

Figure 9:
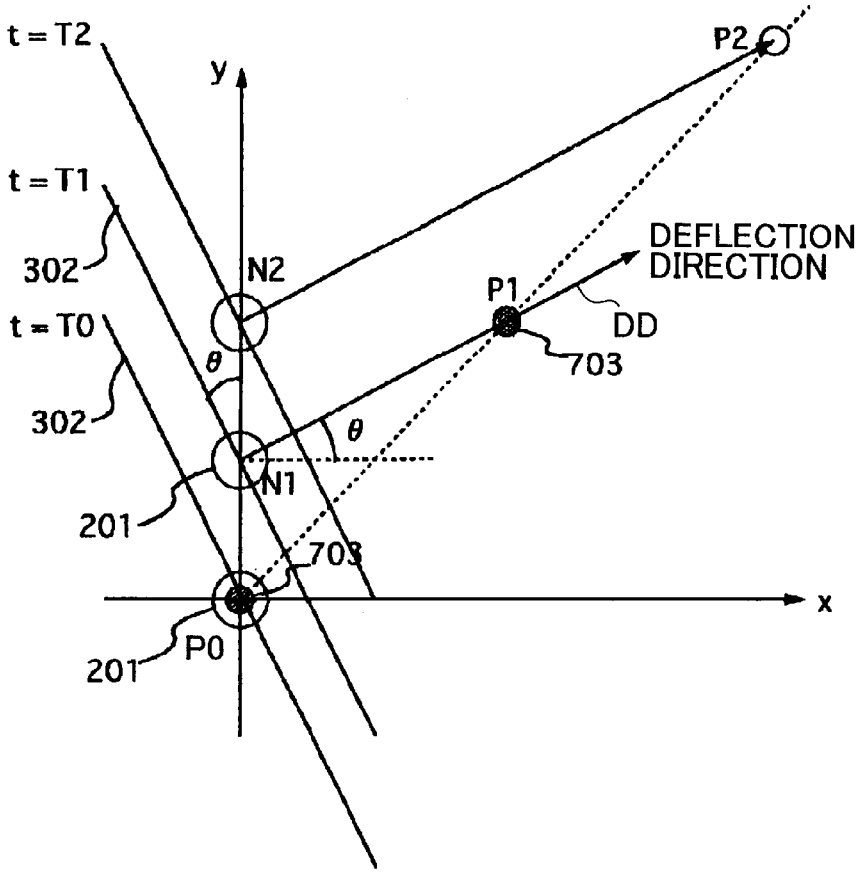
FIG. 9 is an explanatory view showing positional relationships between ejection positions of the orifice and impact positions.

In FIG. 9, it is assumed that the orifice 201 is positioned on an original P0 (0, 0) at a timing T0, and that the ink droplet 501 ejected at the timing TO is not deflected. Accordingly, the impact position 703 of the ink droplet 501 is on the original P0. Because the flying time T is ignored, the ink droplet 501 impacts on the original P0 immediately after the ejection. Next, at a timing T1, the orifice 201 has been moved to a position N1 relative to the recording sheet 502, and subsequent ink droplet 501 is ejected. The ejected ink droplet 501 is deflected in a deflection direction DD, and an impact position 703 is on a position P1 in this case. Because the flying time T is ignored, the ink droplet 501 immediately impacts on the position P1 after the ejection.

As described above, the orifice 201 ejects n ink droplets 501 while the orifice 201 moves by a distance of dy, which is equivalent to one-dot-worth of distance. Therefore, the orifice 201 repeatedly ejects the ink droplet 501 each time at the original P0, the position N1, a position N2, N3, . . . , Nn−1 by the time the orifice 201 moves by the distance of dy. The impact positions 703 are on the original P0, the position P1, a position P2, P3, . . . Pn−1. Then, the same processes are repeatedly performed for each dy, where the positions of impact positions 703 in relative to ejection positions of the orifice 201 are maintained uniform.

Next, the above-mentioned four conditions will be described.

A first condition is that the ejection intervals of ink droplets 501 are uniform. The ejection intervals can be either the ejection time interval or ejection positional interval. The same effect can be obtained in either case. In the present example, it is assumed that the ejection interval is the ejection positional interval.

As described above, n ink droplets 501 are ejected from a single orifice 201 while the orifice 201 moves by a distance of dy in the y direction. Therefore, the ejection positions of the orifice plate 212 are N1(0,(1/n)·dy), N2(0,(2/n)·dy), N3(0,(3/n)·dy), . . . and on.

Usually, the orifice 201 has a maximum ejection rate, and an ejection rate greater than this maximum ejection rate undesirably fluctuates the flying speed of ejected ink droplets 501, resulting in undesirable image quality. When the ejection intervals are uniform, the maximum ejection rate can be used, and high-resolution image can be formed at high speed rate.

A second condition is that the deflection direction DD in perpendicular to the orifice-line direction 302 because the common electrodes 401, 402 extend parallel to the orifice-line direction 302 as described above. The flying time T can be ignored as described above.

In FIG. 9, it is assumed that the position P1 is on (x1·dx, y1·dy), where x1 and y1 are real numbers. Because the deflection direction DD is perpendicular to the orifice-line direction 302, following equations Eq1 are obtained:

$$\tan\theta=(y\mathbf{1}\cdot dy-(1/n)\cdot dy)/(x\mathbf{1}\cdot dx)$$

$$\tan\theta=r\cdot(y\mathbf{1}-(1/n))/x\mathbf{1} \qquad \text{(Eq1)}$$

Figure 10:
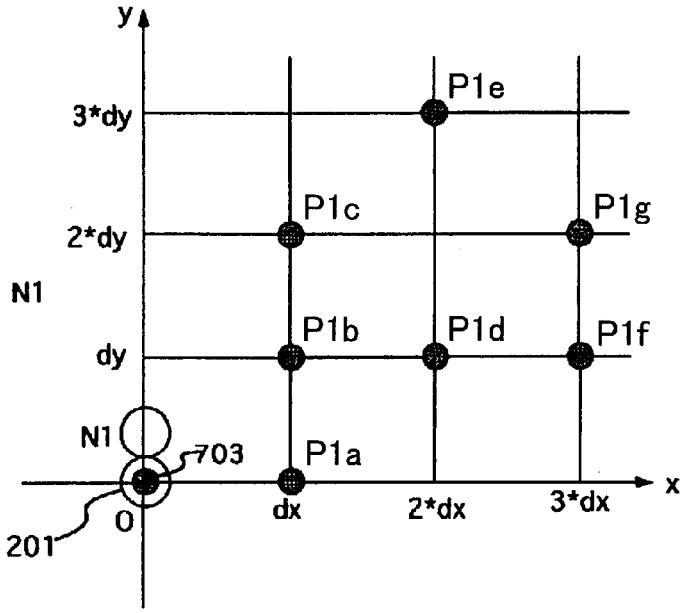
FIG. 10 is an explanatory view showing impact positions.

A third condition is that all the impact positions 703 (P1, P2, P3, . . . ) of deflected ink droplets 501 are all on the grid corners 704*a*. This condition is usually required in printers handling standardized digital data, and is met when the position P1 is on any one of the grid corners 704*a* except on the original P0 and on the y axis. However, because the actual deflection amount C takes only relatively small amount, the impact positions 703 cannot be on a grid corner far from the original P0. FIG. 10 shows seven examples of position P1.

When the position P1 is managed to be on the grid corner 704*a,* then remaining positions P2, P3, . . . Pn−1 are also on the grid corners 704*a* inevitably. However, because it is preferable that the deflection amount C take a small amount, the position P1 is on the grid corner 704*a* close to the original P0.

Because of the symmetry in the left and the right and the above and the below, the grid corners in only the first quadrant including the x axis are considered.

A fourth condition is that deflection timings are equal in all the orifices 201. Because the common electrodes 401, 402 are used, the magnitudes of the charging electric field E1 and the deflector electric field E2 are naturally the same among the all orifices 201.

Because the orifice 201 moves by the distance dy at the deflected-dot frequency, the variable ky of the y-direction orifice interval ky·dy is an integral number in order to uniform the deflection directions DD of the orifices 201.

There are provided following equations Eq2:

$$ky\cdot dy=kx\cdot dx/\tan\theta$$

$$\tan\theta=(kx/ky)/r \qquad \text{(E2)}$$

wherein ky·dy represents the y-direction orifice interval;

kx·dx represents the x-direction orifice interval;

θ is the inclination of the orifice-line direction 302 with respect to the y direction;

kx is the variable;

dy is the resolution interval; and r is the grid squareness rate.

Accordingly, following equations Eq3 are obtained from the above equations Eq1 and Eq2:

$$r\cdot(y\mathbf{1}\cdot(1/n))/x\mathbf{1}=\pm(kx/ky)/r$$

$$r=((kx/ky)\cdot(x\mathbf{1}/(y\mathbf{1}-1/n)))^{0.5}$$

(only when y1>=1/n)

$$r=(-(kx/ky)\cdot(x\mathbf{1}/(y\mathbf{1}-1/n)))^{0.5}$$

(only when y1<1/n)

The resolution interval dx is obtained by a following equation E4:

$$dx=D\cdot(kx^2+(ky\cdot r)^2)^{0.5} \qquad \text{(E4)}$$

wherein D is the orifice interval in the orifice-line direction 302.

Next, specific examples of the nozzle structures that satisfy all of the above four conditions will be described.

In FIG. 10, coordinate values of the positions P1*a* through P1*g* are (1·dx, 0·dy), (1·dx, 1·dy), (1·dx, 2·dy), (2·dx, 1·dy), (2·dx, 3·dy), (3·dx, 1·dy), and (3·dx, 2·dy), respectively.

The following tables TB1(*a*) through TB7(*c*) shows the grid squareness rates r, the values of tan θ, and x-resolution 1/dx (dpi) for when the position P is one of the positions P1*a* through P1*g,* that satisfy the all the above four conditions. These values are obtained for when the n is changed from 2 through 5 and the variables kx and ky of the nozzle intervals kx·dx and ky·dy are changed. It should be noted that orifice pitch is 75 nozzles/inch (D=339 μm). The x-resolution 1/dx (dpi) and the tanθ are obtained by the above equation Eq3 and Eq2. The y-resolution 1/dy equals 1/(r/dx).

TABLE T1

| n | 2 | 2 | 3 | 3 | 3 | 4 | 4 | 4 | 4 | 5 | 5 | 5 | 5 | 5 |
|---|---|---|---|---|---|---|---|---|---|---|---|---|---|---|
| ky kx | 1 | 2 | 1 | 2 | 3 | 1 | 2 | 3 | 4 | 1 | 2 | 3 | 4 | 5 |
| | | | | | | | (a) grid flatness rate r | | | | | | | |
| 1 | 1.414 | 2 | 1.732 | 2.449 | 3 | 2 | 2.828 | 3.464 | 4 | 2.236 | 3.162 | 3.873 | 4.472 | 5 |
| 2 | 1 | 1.414 | 1.225 | 1.732 | 2.121 | 1.414 | 2 | 2.449 | 2.828 | 1.581 | 2.236 | 2.739 | 3.162 | 3.536 |
| 3 | 0.816 | 1.155 | 1 | 1.414 | 1.732 | 1.155 | 1.633 | 2 | 2.309 | 1.281 | 1.826 | 2.236 | 2.582 | 2.887 |
| 4 | 0.707 | 1 | 0.866 | 1.225 | 1.5 | 1 | 1.414 | 1.732 | 2 | 1.118 | 1.581 | 1.936 | 2.236 | 2.5 |
| 5 | 0.632 | 0.894 | 0.775 | 1.095 | 1.342 | 0.894 | 1.265 | 1.549 | 1.789 | 1 | 1.414 | 1.732 | 2 | 2.236 |
| 6 | 0.577 | 0.816 | 0.707 | 1 | 1.225 | 0.816 | 1.155 | 1.414 | 1.633 | 0.913 | 1.291 | 1.581 | 1.826 | 2.041 |
| 7 | 0.535 | 0.756 | 0.655 | 0.926 | 1.134 | 0.756 | 1.069 | 1.309 | 1.512 | 0.845 | 1.195 | 1.464 | 1.69 | 1.89 |

TABLE T1-continued

| n | 2 | 2 | 3 | 3 | 3 | 4 | 4 | 4 | 4 | 5 | 5 | 5 | 5 | 5 |
|---|---|---|---|---|---|---|---|---|---|---|---|---|---|---|
| ky kx | 1 | 2 | 1 | 2 | 3 | 1 | 2 | 3 | 4 | 1 | 2 | 3 | 4 | 5 |
| 8 | 0.5 | 0.707 | 0.612 | 0.866 | 1.061 | 0.707 | 1 | 1.225 | 1.414 | 0.791 | 1.118 | 1.369 | 1.581 | 1.768 |
| 9 | 0.471 | 0.667 | 0.577 | 0.816 | 1 | 0.667 | 0.943 | 1.155 | 1.333 | 0.745 | 1.054 | 1.291 | 1.491 | 1.667 |
| 10 | 0.447 | 0.632 | 0.548 | 0.775 | 0.949 | 0.632 | 0.894 | 1.095 | 1.265 | 0.707 | 1 | 1.225 | 1.414 | 1.581 |
| 16 | 0.354 | 0.5 | 0.433 | 0.612 | 0.75 | 0.5 | 0.707 | 0.866 | 1 | 0.559 | 0.791 | 0.968 | 1.118 | 1.25 |
| | | | | | | | (b) tan θ | | | | | | | |
| 1 | 0.707 | 1 | 0.577 | 0.816 | 1 | 0.5 | 0.707 | 0.866 | 1 | 0.447 | 0.632 | 0.775 | 0.894 | 1 |
| 2 | 0.5 | 0.707 | 0.408 | 0.577 | 0.707 | 0.354 | 0.5 | 0.612 | 0.707 | 0.316 | 0.447 | 0.548 | 0.632 | 0.707 |
| 3 | 0.408 | 0.577 | 0.333 | 0.471 | 0.577 | 0.289 | 0.408 | 0.5 | 0.577 | 0.258 | 0.365 | 0.447 | 0.516 | 0.577 |
| 4 | 0.354 | 0.5 | 0.289 | 0.408 | 0.5 | 0.25 | 0.354 | 0.433 | 0.5 | 0.224 | 0.316 | 0.387 | 0.447 | 0.5 |
| 5 | 0.316 | 0.447 | 0.258 | 0.365 | 0.447 | 0.224 | 0.316 | 0.387 | 0.447 | 0.2 | 0.283 | 0.346 | 0.4 | 0.447 |
| 6 | 0.289 | 0.408 | 0.236 | 0.333 | 0.408 | 0.204 | 0.289 | 0.354 | 0.408 | 0.183 | 0.258 | 0.316 | 0.365 | 0.408 |
| 7 | 0.267 | 0.378 | 0.218 | 0.309 | 0.378 | 0.189 | 0.267 | 0.327 | 0.378 | 0.169 | 0.239 | 0.293 | 0.338 | 0.378 |
| 8 | 0.25 | 0.354 | 0.204 | 0.289 | 0.354 | 0.177 | 0.25 | 0.306 | 0.354 | 0.158 | 0.224 | 0.274 | 0.316 | 0.354 |
| 9 | 0.236 | 0.333 | 0.192 | 0.272 | 0.333 | 0.167 | 0.236 | 0.289 | 0.333 | 0.149 | 0.211 | 0.258 | 0.298 | 0.333 |
| 10 | 0.224 | 0.316 | 0.183 | 0.258 | 0.316 | 0.158 | 0.224 | 0.274 | 0.316 | 0.141 | 0.2 | 0.245 | 0.283 | 0.316 |
| 16 | 0.177 | 0.25 | 0.144 | 0.204 | 0.25 | 0.125 | 0.177 | 0.217 | 0.25 | 0.112 | 0.158 | 0.194 | 0.224 | 0.25 |
| | | | | | | | (c) x-resolution l/dx | | | | | | | |
| 1 | 129.9 | 212.1 | 150 | 237.2 | 318.2 | 167.7 | 259.8 | 343.7 | 424.3 | 183.7 | 280.6 | 367.4 | 450 | 530.3 |
| 2 | 167.7 | 259.8 | 198.4 | 300 | 389.7 | 225 | 335.4 | 430.8 | 519.6 | 248.7 | 367.4 | 468.4 | 561.2 | 649.5 |
| 3 | 198.4 | 300 | 237.2 | 351.8 | 450 | 270.4 | 396.9 | 503.1 | 600 | 300 | 437.3 | 551.1 | 653.8 | 750 |
| 4 | 225 | 335.4 | 270.4 | 396.9 | 503.1 | 309.2 | 450 | 566.2 | 670.8 | 343.7 | 497.5 | 623 | 734.8 | 838.5 |
| 5 | 248.7 | 367.4 | 300 | 437.3 | 551.1 | 343.7 | 497.5 | 623 | 734.8 | 382.4 | 551.1 | 687.4 | 807.8 | 918.6 |
| 6 | 270.4 | 396.9 | 326.9 | 474.3 | 595.3 | 375 | 540.8 | 675 | 793.7 | 417.6 | 600 | 746.2 | 874.6 | 992.2 |
| 7 | 290.5 | 424.3 | 351.8 | 508.7 | 636.4 | 403.9 | 580.9 | 723.3 | 848.5 | 450 | 645.2 | 800.8 | 936.7 | 1061 |
| 8 | 309.2 | 450 | 375 | 540.8 | 675 | 430.8 | 618.5 | 768.5 | 900 | 480.2 | 687.4 | 851.8 | 995 | 1125 |
| 9 | 326.9 | 474.3 | 396.9 | 571.2 | 711.5 | 456.2 | 653.8 | 811.2 | 948.7 | 508.7 | 727.2 | 900 | 1050 | 1186 |
| 10 | 343.7 | 497.5 | 417.6 | 600 | 746.2 | 480.2 | 687.4 | 851.8 | 995 | 535.6 | 764.9 | 945.7 | 1102 | 1244 |
| 16 | 430.8 | 618.5 | 525 | 750 | 927.7 | 604.7 | 861.7 | 1063 | 1237 | 675 | 960.5 | 1183 | 1375 | 1546 |

TABLE T2

| n | 2 | 2 | 3 | 3 | 3 | 4 | 4 | 4 | 4 | 5 | 5 | 5 | 5 | 5 |
|---|---|---|---|---|---|---|---|---|---|---|---|---|---|---|
| ky kx | 1 | 2 | 1 | 2 | 3 | 1 | 2 | 3 | 4 | 1 | 2 | 3 | 4 | 5 |
| | | | | | | | (a) grid flatness rate r | | | | | | | |
| 1 | 1.414 | 2 | 1.225 | 1.732 | 2.121 | 1.155 | 1.633 | 2 | 2.309 | 1.118 | 1.581 | 1.936 | 2.236 | 2.5 |
| 2 | 1 | 1.414 | 0.866 | 1.225 | 1.5 | 0.816 | 1.155 | 1.414 | 1.633 | 0.791 | 1.118 | 1.369 | 1.581 | 1.768 |
| 3 | 0.816 | 1.155 | 0.707 | 1 | 1.225 | 0.667 | 0.943 | 1.155 | 1.333 | 0.645 | 0.913 | 1.118 | 1.291 | 1.443 |
| 4 | 0.707 | 1 | 0.612 | 0.866 | 1.061 | 0.577 | 0.816 | 1 | 1.155 | 0.559 | 0.791 | 0.968 | 1.118 | 1.25 |
| 5 | 0.632 | 0.894 | 0.548 | 0.775 | 0.949 | 0.516 | 0.73 | 0.894 | 1.033 | 0.5 | 0.707 | 0.866 | 1 | 1.118 |
| 6 | 0.577 | 0.816 | 0.5 | 0.707 | 0.866 | 0.471 | 0.667 | 0.816 | 0.943 | 0.456 | 0.645 | 0.791 | 0.913 | 1.021 |
| 7 | 0.535 | 0.756 | 0.463 | 0.655 | 0.802 | 0.436 | 0.617 | 0.756 | 0.873 | 0.423 | 0.598 | 0.732 | 0.845 | 0.945 |
| 8 | 0.5 | 0.707 | 0.433 | 0.612 | 0.75 | 0.408 | 0.577 | 0.707 | 0.816 | 0.395 | 0.559 | 0.685 | 0.791 | 0.884 |
| 9 | 0.471 | 0.667 | 0.408 | 0.577 | 0.707 | 0.385 | 0.544 | 0.667 | 0.77 | 0.373 | 0.527 | 0.645 | 0.745 | 0.833 |
| 10 | 0.447 | 0.632 | 0.387 | 0.548 | 0.671 | 0.365 | 0.516 | 0.632 | 0.73 | 0.354 | 0.5 | 0.612 | 0.707 | 0.791 |
| | | | | | | | (b) tan θ | | | | | | | |
| 1 | 0.707 | 1 | 0.816 | 1.155 | 1.414 | 0.866 | 1.225 | 1.5 | 1.732 | 0.894 | 1.265 | 1.549 | 1.789 | 2 |
| 2 | 0.5 | 0.707 | 0.577 | 0.816 | 1 | 0.612 | 0.866 | 1.061 | 1.225 | 0.632 | 0.894 | 1.095 | 1.265 | 1.414 |
| 3 | 0.408 | 0.577 | 0.471 | 0.667 | 0.816 | 0.5 | 0.707 | 0.866 | 1 | 0.516 | 0.73 | 0.894 | 1.033 | 1.155 |
| 4 | 0.354 | 0.5 | 0.408 | 0.577 | 0.707 | 0.435 | 0.612 | 0.75 | 0.866 | 0.447 | 0.632 | 0.775 | 0.894 | 1 |
| 5 | 0.316 | 0.447 | 0.365 | 0.516 | 0.632 | 0.387 | 0.548 | 0.671 | 0.775 | 0.4 | 0.566 | 0.693 | 0.8 | 0.894 |
| 6 | 0.289 | 0.408 | 0.333 | 0.471 | 0.577 | 0.354 | 0.5 | 0.612 | 0.707 | 0.365 | 0.516 | 0.632 | 0.73 | 0.816 |
| 7 | 0.267 | 0.378 | 0.309 | 0.436 | 0.535 | 0.327 | 0.463 | 0.567 | 0.655 | 0.338 | 0.478 | 0.586 | 0.676 | 0.756 |
| 8 | 0.25 | 0.354 | 0.289 | 0.408 | 0.5 | 0.306 | 0.433 | 0.53 | 0.612 | 0.316 | 0.447 | 0.548 | 0.632 | 0.707 |
| 9 | 0.236 | 0.333 | 0.272 | 0.385 | 0.471 | 0.289 | 0.408 | 0.5 | 0.577 | 0.298 | 0.422 | 0.516 | 0.596 | 0.667 |
| 10 | 0.224 | 0.316 | 0.258 | 0.365 | 0.447 | 0.274 | 0.387 | 0.474 | 0.548 | 0.283 | 0.4 | 0.49 | 0.566 | 0.632 |
| | | | | | | | (c) x-resolution l/dx | | | | | | | |
| 1 | 129.9 | 212.1 | 118.6 | 198.4 | 275.6 | 114.6 | 193.6 | 270.4 | 346.4 | 112.5 | 191.2 | 267.8 | 343.7 | 419.3 |
| 2 | 167.7 | 259.8 | 150 | 237.2 | 318.2 | 143.6 | 229.1 | 309.2 | 387.3 | 140.3 | 225 | 304.7 | 382.4 | 459.3 |
| 3 | 198.4 | 300 | 175.9 | 270.4 | 355.8 | 167.7 | 259.8 | 343.7 | 424.3 | 163.5 | 254.3 | 337.5 | 417.6 | 496.1 |
| 4 | 225 | 335.4 | 198.4 | 300 | 389.7 | 188.7 | 287.2 | 375 | 458.3 | 183.7 | 280.6 | 367.4 | 450 | 530.3 |
| 5 | 248.7 | 367.4 | 218.7 | 326.9 | 420.9 | 207.7 | 31.2 | 403.9 | 489.9 | 201.9 | 304.7 | 395.1 | 480.2 | 562.5 |

TABLE T2-continued

| n | 2 | 2 | 3 | 3 | 3 | 4 | 4 | 4 | 4 | 5 | 5 | 5 | 5 | 5 |
|---|---|---|---|---|---|---|---|---|---|---|---|---|---|---|
| ky kx | 1 | 2 | 1 | 2 | 3 | 1 | 2 | 3 | 4 | 1 | 2 | 3 | 4 | 5 |
| 6 | 270.4 | 396.9 | 237.2 | 351.8 | 450 | 225 | 335.4 | 430.8 | 519.6 | 218.7 | 326.9 | 420.9 | 508.7 | 592.9 |
| 7 | 290.5 | 42.3 | 254.3 | 375 | 477.3 | 241.1 | 357.1 | 456.2 | 547.7 | 2342 | 347.8 | 445.3 | 535.6 | 621.9 |
| 8 | 309.2 | 450 | 270.4 | 396.9 | 503.1 | 256.2 | 377.5 | 480.2 | 574.5 | 248.7 | 367.4 | 468.4 | 561.2 | 649.5 |
| 9 | 326.9 | 474.3 | 285.6 | 417.6 | 527.7 | 270.4 | 396.9 | 503.1 | 600 | 2625 | 386.1 | 490.4 | 585.8 | 676 |
| 10 | 343.7 | 497.5 | 300 | 437.3 | 551.1 | 283.9 | 415.3 | 525 | 624.5 | 275.6 | 403.9 | 511.4 | 609.3 | 701.6 |

TABLE T3

| n | 2 | 2 | 3 | 3 | 3 | 4 | 4 | 4 | 4 | 5 | 5 | 5 | 5 | 5 |
|---|---|---|---|---|---|---|---|---|---|---|---|---|---|---|
| ky kx | 1 | 2 | 1 | 2 | 3 | 1 | 2 | 3 | 4 | 1 | 2 | 3 | 4 | 5 |
| (a) grid flatness rate r | | | | | | | | | | | | | | |
| 1 | 0.816 | 1.155 | 0.775 | 1.095 | 1.342 | 0.756 | 1.069 | 1.309 | 1.512 | 0.745 | 1.054 | 1.291 | 1.491 | 1.667 |
| 2 | 0.577 | 0.816 | 0.548 | 0.775 | 0.949 | 0.535 | 0.756 | 0.926 | 1.069 | 0.527 | 0.745 | 0.913 | 1.054 | 1.179 |
| 3 | 0.471 | 0.667 | 0.447 | 0.632 | 0.775 | 0.436 | 0.617 | 0.756 | 0.873 | 0.43 | 0.609 | 0.745 | 0.861 | 0.962 |
| 4 | 0.408 | 0.577 | 0.387 | 0.548 | 0.671 | 0.378 | 0.535 | 0.655 | 0.756 | 0.373 | 0.527 | 0.645 | 0.745 | 0.833 |
| 5 | 0.365 | 0.516 | 0.346 | 0.49 | 0.6 | 0.338 | 0.478 | 0.586 | 0.676 | 0.333 | 0.471 | 0.577 | 0.667 | 0.745 |
| 6 | 0.333 | 0.471 | 0.316 | 0.447 | 0.548 | 0.309 | 0.436 | 0.535 | 0.617 | 0.304 | 0.43 | 0.527 | 0.609 | 0.68 |
| 7 | 0.309 | 0.436 | 0.293 | 0.414 | 0.507 | 0.286 | 0.404 | 0.495 | 0.571 | 0.282 | 0.398 | 0.488 | 0.563 | 0.63 |
| 8 | 0.289 | 0.408 | 0.274 | 0.387 | 0.474 | 0.267 | 0.378 | 0.463 | 0.535 | 0.264 | 0.373 | 0.456 | 0.527 | 0.589 |
| 9 | 0.272 | 0.385 | 0.258 | 0.365 | 0.447 | 0.252 | 0.356 | 0.436 | 0.504 | 0.248 | 0.351 | 0.43 | 0.497 | 0.556 |
| 10 | 0.258 | 0.365 | 0.245 | 0.346 | 0.424 | 0.239 | 0.338 | 0.414 | 0.478 | 0.236 | 0.333 | 0.408 | 0.471 | 0.527 |
| (b) tan θ | | | | | | | | | | | | | | |
| 1 | 1.225 | 1.732 | 1.291 | 1.826 | 2.236 | 1.323 | 1.871 | 2.291 | 2.646 | 1.342 | 1.897 | 2.324 | 2.683 | 3 |
| 2 | 0.866 | 1.225 | 0.913 | 1.291 | 1.581 | 0.935 | 1.323 | 1.62 | 1.871 | 0.949 | 1.342 | 1.643 | 1.897 | 2.121 |
| 3 | 0.707 | 1 | 0.745 | 1.054 | 1.291 | 0.764 | 1.08 | 1.323 | 1.528 | 0.775 | 1.095 | 1.342 | 1.549 | 1.732 |
| 4 | 0.612 | 0.866 | 0.645 | 0.913 | 1.118 | 0.661 | 0.935 | 1.146 | 1.323 | 0.671 | 0.949 | 1.162 | 1.342 | 1.5 |
| 5 | 0.548 | 0.775 | 0.577 | 0.816 | 1 | 0.592 | 0.837 | 1.025 | 1.183 | 0.6 | 0.849 | 1.039 | 1.2 | 1.342 |
| 6 | 0.5 | 0.707 | 0.527 | 0.745 | 0.913 | 0.54 | 0.764 | 0.935 | 1.08 | 0.548 | 0.775 | 0.949 | 1.095 | 1.225 |
| 7 | 0.463 | 0.655 | 0.488 | 0.69 | 0.845 | 0.5 | 0.707 | 0.866 | 1 | 0.507 | 0.717 | 0.878 | 1.014 | 1.134 |
| 8 | 0.433 | 0.612 | 0.456 | 0.645 | 0.791 | 0.468 | 0.661 | 0.81 | 0.935 | 0.474 | 0.671 | 0.822 | 0.949 | 1.061 |
| 9 | 0.408 | 0.577 | 0.43 | 0.609 | 0.745 | 0.441 | 0.624 | 0.764 | 0.882 | 0.447 | 0.632 | 0.775 | 0.894 | 1 |
| 10 | 0.387 | 0.548 | 0.408 | 0.577 | 0.707 | 0.418 | 0.592 | 0.725 | 0.837 | 0.424 | 0.6 | 0.735 | 0.849 | 0.949 |
| (c) x-resolution l/dx | | | | | | | | | | | | | | |
| 1 | 96.82 | 173.2 | 94.87 | 171 | 246.5 | 94.02 | 170.1 | 245.5 | 320.7 | 93.54 | 169.6 | 244.9 | 320.2 | 395.3 |
| 2 | 114.6 | 193.6 | 111.2 | 189.7 | 266.2 | 109.8 | 188 | 264.4 | 340.2 | 109 | 187.1 | 263.4 | 339.1 | 414.6 |
| 3 | 129.9 | 212.1 | 125.5 | 206.8 | 284.6 | 123.6 | 204.4 | 282.1 | 358.6 | 122.5 | 203.1 | 280.6 | 357.1 | 433 |
| 4 | 143.6 | 229.1 | 188.3 | 222.5 | 301.9 | 135.9 | 219.6 | 298.7 | 376.1 | 134.6 | 217.9 | 296.9 | 374.2 | 450.7 |
| 5 | 156.1 | 244.9 | 150 | 237.2 | 318.2 | 147.3 | 233.8 | 314.4 | 392.8 | 145.8 | 231.8 | 312.2 | 390.5 | 467.7 |
| 6 | 167.7 | 259.8 | 160.9 | 251 | 333.7 | 157.8 | 247.1 | 329.4 | 408.8 | 156.1 | 244.9 | 326.9 | 406.2 | 484.1 |
| 7 | 178.5 | 273.9 | 171 | 264.1 | 348.6 | 167.7 | 259.8 | 343.7 | 424.3 | 165.8 | 257.4 | 341 | 421.3 | 500 |
| 8 | 188.7 | 287.2 | 180.6 | 276.6 | 362.8 | 177 | 271.9 | 357.4 | 439.2 | 175 | 269.3 | 354.4 | 435.9 | 515.4 |
| 9 | 198.4 | 300 | 189.7 | 288.5 | 376.5 | 185.9 | 283.5 | 370.7 | 453.6 | 183.7 | 280.6 | 367.4 | 450 | 530.3 |
| 10 | 207.7 | 312.2 | 198.4 | 300 | 389.7 | 194.3 | 294.6 | 383.5 | 467.5 | 192 | 291.5 | 380 | 463.7 | 544.9 |

TABLE T4

| n | 2 | 2 | 3 | 3 | 3 | 4 | 4 | 4 | 4 | 5 | 5 | 5 | 5 | 5 |
|---|---|---|---|---|---|---|---|---|---|---|---|---|---|---|
| ky kx | 1 | 2 | 1 | 2 | 3 | 1 | 2 | 3 | 4 | 1 | 2 | 3 | 4 | 5 |
| (a) grid flatness rate r | | | | | | | | | | | | | | |
| 1 | 2 | 2.828 | 1.732 | 2.449 | 3 | 1.633 | 2.309 | 2.828 | 3.266 | 1.581 | 2.236 | 2.739 | 3.162 | 3.536 |
| 2 | 1.414 | 2 | 1.225 | 1.732 | 2.121 | 1.155 | 1.633 | 2 | 2.309 | 1.118 | 1.581 | 1.936 | 2.236 | 2.5 |
| 3 | 1.155 | 1.633 | 1 | 1.414 | 1.732 | 0.943 | 1.333 | 1.633 | 1.888 | 0.913 | 1.291 | 1.581 | 1.826 | 2.041 |
| 4 | 1 | 1.414 | 0.866 | 1.225 | 1.5 | 0.816 | 1.155 | 1.414 | 1.633 | 0.791 | 1.118 | 1.369 | 1.581 | 1.768 |
| 5 | 0.894 | 1.265 | 0.775 | 1.095 | 1.342 | 0.73 | 1.033 | 1.265 | 1.461 | 0.707 | 1 | 1.225 | 1.414 | 1.581 |
| 6 | 0.816 | 1.155 | 0.707 | 1 | 1.225 | 0.667 | 0.943 | 1.155 | 1.333 | 0.645 | 0.913 | 1.118 | 1.291 | 1.443 |
| 7 | 0.756 | 1.069 | 0.655 | 0.926 | 1.134 | 0.617 | 0.873 | 1.069 | 1.234 | 0.598 | 0.845 | 1.035 | 1.195 | 1.336 |
| 8 | 0.707 | 1 | 0.612 | 0.866 | 1.061 | 0.577 | 0.816 | 1 | 1.155 | 0.559 | 0.791 | 0.968 | 1.118 | 1.25 |
| 9 | 0.667 | 0.943 | 0.577 | 0.816 | 1 | 0.544 | 0.77 | 0.943 | 1.089 | 0.527 | 0.745 | 0.913 | 1.054 | 1.179 |
| 10 | 0.632 | 0.894 | 0.548 | 0.775 | 0.949 | 0.516 | 0.73 | 0.894 | 1.033 | 0.5 | 0.707 | 0.866 | 1 | 1.118 |

TABLE T4-continued

| n | 2 | 2 | 3 | 3 | 3 | 4 | 4 | 4 | 4 | 5 | 5 | 5 | 5 | 5 |
|---|---|---|---|---|---|---|---|---|---|---|---|---|---|---|
| ky kx | 1 | 2 | 1 | 2 | 3 | 1 | 2 | 3 | 4 | 1 | 2 | 3 | 4 | 5 |
| | | | | | | | (b) tan θ | | | | | | | |
| 1 | 0.5 | 0.707 | 0.577 | 0.816 | 1 | 0.612 | 0.866 | 1.061 | 1.225 | 0.632 | 0.894 | 1.095 | 1.265 | 1.414 |
| 2 | 0.354 | 0.5 | 0.408 | 0.577 | 0.707 | 0.433 | 0.612 | 0.75 | 0.866 | 0.447 | 0.632 | 0.775 | 0.894 | 1 |
| 3 | 0.289 | 0.408 | 0.333 | 0.471 | 0.577 | 0.354 | 0.5 | 0.612 | 0.707 | 0.365 | 0.516 | 0.632 | 0.73 | 0.816 |
| 4 | 0.25 | 0.354 | 0.289 | 0.408 | 0.5 | 0.306 | 0.433 | 0.53 | 0.612 | 0.316 | 0.447 | 0.548 | 0.632 | 0.707 |
| 5 | 0.224 | 0.316 | 0.258 | 0.365 | 0.447 | 0.274 | 0.387 | 0.474 | 0.548 | 0.283 | 0.4 | 0.49 | 0.566 | 0.632 |
| 6 | 0.204 | 0.289 | 0.236 | 0.333 | 0.408 | 0.25 | 0.354 | 0.433 | 0.5 | 0.258 | 0.365 | 0.447 | 0.516 | 0.577 |
| 7 | 0.189 | 0.267 | 0.218 | 0.309 | 0.378 | 0.231 | 0.327 | 0.401 | 0.463 | 0.239 | 0.338 | 0.414 | 0.478 | 0.535 |
| 8 | 0.177 | 0.25 | 0.204 | 0.289 | 0.354 | 0.217 | 0.308 | 0.375 | 0.433 | 0.224 | 0.316 | 0.387 | 0.447 | 0.5 |
| 9 | 0.167 | 0.238 | 0.192 | 0.272 | 0.333 | 0.204 | 0.289 | 0.354 | 0.408 | 0.211 | 0.298 | 0.365 | 0.422 | 0.471 |
| 10 | 0.158 | 0.224 | 0.183 | 0.258 | 0.316 | 0.194 | 0.274 | 0.335 | 0.387 | 0.2 | 0.283 | 0.346 | 0.4 | 0.447 |
| | | | | | | | (c) x-resolution 1/dx | | | | | | | |
| 1 | 167.7 | 259.8 | 150 | 237.2 | 318.2 | 143.6 | 229.1 | 309.2 | 387.3 | 140.3 | 225 | 304.7 | 382.4 | 459.3 |
| 2 | 225 | 335.4 | 198.4 | 300 | 389.7 | 188.7 | 287.2 | 375 | 458.3 | 183.7 | 280.6 | 367.4 | 450 | 530.3 |
| 3 | 270.4 | 396.9 | 237.2 | 351.8 | 450 | 225 | 335.4 | 430.8 | 519.6 | 218.7 | 326.9 | 420.9 | 508.7 | 592.9 |
| 4 | 309.2 | 450 | 270.4 | 396.9 | 503.1 | 256.2 | 377.5 | 480.2 | 574.5 | 248.7 | 367.4 | 468.4 | 561.2 | 649.5 |
| 5 | 343.7 | 497.5 | 300 | 437.3 | 551.1 | 283.9 | 415.3 | 525 | 624.5 | 275.6 | 403.9 | 511.4 | 609.3 | 701.6 |
| 6 | 375 | 540.8 | 326.9 | 474.3 | 595.3 | 309.2 | 450 | 566.2 | 670.8 | 300 | 437.3 | 551.1 | 653.8 | 750 |
| 7 | 403.9 | 580.9 | 351.8 | 508.7 | 636.4 | 332.6 | 482.2 | 604.7 | 714.1 | 322.6 | 468.4 | 588.2 | 695.5 | 795.5 |
| 8 | 430.8 | 618.5 | 375 | 540.8 | 675 | 354.4 | 512.3 | 640.8 | 755 | 343.7 | 497.5 | 623 | 734.8 | 838.5 |
| 9 | 456.2 | 653.8 | 396.9 | 571.2 | 711.5 | 375 | 540.8 | 675 | 793.7 | 363.6 | 525 | 656 | 772.2 | 879.5 |
| 10 | 480.2 | 687.4 | 417.6 | 600 | 746.2 | 394.5 | 567.9 | 707.5 | 830.7 | 382.4 | 551.1 | 687.4 | 807.8 | 918.6 |

TABLE 5

| n | 2 | 2 | 3 | 3 | 3 | 4 | 4 | 4 | 4 | 5 | 5 | 5 | 5 | 5 |
|---|---|---|---|---|---|---|---|---|---|---|---|---|---|---|
| ky kx | 1 | 2 | 1 | 2 | 3 | 1 | 2 | 3 | 4 | 1 | 2 | 3 | 4 | 5 |
| | | | | | | | (a) grid flatness rate r | | | | | | | |
| 1 | 0.894 | 1.265 | 0.866 | 1.225 | 1.5 | 0.853 | 1.206 | 1.477 | 1.706 | 0.845 | 1.195 | 1.464 | 1.69 | 1.89 |
| 2 | 0.632 | 0.894 | 0.612 | 0.866 | 1.061 | 0.603 | 0.853 | 1.044 | 1.206 | 0.598 | 0.845 | 1.035 | 1.195 | 1.336 |
| 3 | 0.516 | 0.73 | 0.5 | 0.707 | 0.866 | 0.492 | 0.696 | 0.853 | 0.985 | 0.488 | 0.69 | 0.845 | 0.976 | 1.091 |
| 4 | 0.447 | 0.632 | 0.433 | 0.612 | 0.75 | 0.426 | 0.603 | 0.739 | 0.853 | 0.423 | 0.598 | 0.732 | 0.845 | 0.945 |
| 5 | 0.4 | 0.566 | 0.387 | 0.548 | 0.671 | 0.381 | 0.539 | 0.661 | 0.763 | 0.378 | 0.535 | 0.655 | 0.756 | 0.845 |
| 6 | 0.365 | 0.516 | 0.354 | 0.5 | 0.612 | 0.348 | 0.492 | 0.603 | 0.696 | 0.345 | 0.488 | 0.598 | 0.69 | 0.772 |
| 7 | 0.338 | 0.478 | 0.327 | 0.463 | 0.567 | 0.322 | 0.456 | 0.558 | 0.645 | 0.319 | 0.452 | 0.553 | 0.639 | 0.714 |
| 8 | 0.316 | 0.447 | 0.306 | 0.433 | 0.53 | 0.302 | 0.426 | 0.522 | 0.603 | 0.299 | 0.423 | 0.518 | 0.598 | 0.668 |
| 9 | 0.298 | 0.422 | 0.289 | 0.408 | 0.5 | 0.284 | 0.402 | 0.492 | 0.569 | 0.282 | 0.398 | 0.488 | 0.563 | 0.63 |
| 10 | 0.283 | 0.4 | 0.274 | 0.387 | 0.474 | 0.27 | 0.381 | 0.467 | 0.539 | 0.267 | 0.378 | 0.463 | 0.535 | 0.598 |
| | | | | | | | (b) tan θ | | | | | | | |
| 1 | 1.118 | 1.581 | 1.155 | 1.633 | 2 | 1.173 | 1.658 | 2.031 | 2.345 | 1.183 | 1.673 | 2.049 | 2.366 | 2.646 |
| 2 | 0.791 | 1.118 | 0.816 | 1.155 | 1.414 | 0.829 | 1.173 | 1.436 | 1.658 | 0.837 | 1.183 | 1.449 | 1.673 | 1.871 |
| 3 | 0.645 | 0.913 | 0.667 | 0.943 | 1.155 | 0.677 | 0.957 | 1.173 | 1.354 | 0.683 | 0.966 | 1.183 | 1.366 | 1.528 |
| 4 | 0.559 | 0.791 | 0.577 | 0.816 | 1 | 0.586 | 0.829 | 1.016 | 1.173 | 0.592 | 0.837 | 1.025 | 1.183 | 1.323 |
| 5 | 0.5 | 0.707 | 0.516 | 0.73 | 0.894 | 0.524 | 0.742 | 0.908 | 1.049 | 0.529 | 0.748 | 0.917 | 1.058 | 1.183 |
| 6 | 0.456 | 0.645 | 0.471 | 0.667 | 0.816 | 0.479 | 0.677 | 0.829 | 0.957 | 0.483 | 0.683 | 0.837 | 0.966 | 1.08 |
| 7 | 0.423 | 0.598 | 0.436 | 0.617 | 0.756 | 0.443 | 0.627 | 0.768 | 0.886 | 0.447 | 0.632 | 0.775 | 0.894 | 1 |
| 8 | 0.395 | 0.559 | 0.408 | 0.577 | 0.707 | 0.415 | 0.586 | 0.718 | 0.829 | 0.418 | 0.592 | .725 | 0.837 | 0.935 |
| 9 | 0.373 | 0.527 | 0.385 | 0.544 | 0.667 | 0.391 | 0.553 | 0.677 | 0.782 | 0.394 | 0.558 | 0.683 | 0.789 | 0.882 |
| 10 | 0.354 | 0.5 | 0.365 | 0.516 | 0.632 | 0.371 | 0.524 | 0.642 | 0.742 | 0.374 | 0.529 | 0.648 | 0.748 | 0.837 |
| | | | | | | | (c) x-resolution 1/dx | | | | | | | |
| 1 | 100.6 | 177.5 | 99.22 | 175.9 | 251.6 | 98.57 | 175.2 | 250.8 | 326.1 | 98.2 | 174.7 | 250.4 | 325.7 | 400.9 |
| 2 | 120.9 | 201.2 | 118.6 | 198.4 | 275.6 | 117.5 | 197.1 | 274.2 | 350.3 | 116.9 | 196.4 | 273.4 | 349.5 | 425.2 |
| 3 | 138.3 | 222.5 | 135.2 | 218.7 | 297.6 | 133.8 | 216.9 | 295.7 | 372.9 | 133 | 215.9 | 294.6 | 371.8 | 448.2 |
| 4 | 153.7 | 241.9 | 150 | 237.2 | 318.2 | 148.3 | 235 | 315.8 | 394.3 | 147.3 | 233.8 | 314.4 | 392.8 | 470.1 |
| 5 | 167.7 | 259.8 | 163.5 | 254.3 | 337.5 | 161.5 | 251.8 | 334.6 | 414.5 | 160.4 | 250.4 | 333 | 412.7 | 491 |
| 6 | 180.6 | 276.6 | 175.9 | 270.4 | 355.8 | 173.7 | 267.6 | 352.5 | 433.8 | 172.4 | 265.9 | 350.6 | 431.8 | 511 |
| 7 | 192.7 | 292.4 | 187.5 | 285.6 | 373.1 | 185.1 | 282.4 | 369.5 | 452.3 | 183.7 | 280.6 | 367.4 | 450 | 530.3 |
| 8 | 204 | 307.4 | 198.4 | 300 | 389.7 | 195.8 | 296.6 | 385.8 | 470 | 194.3 | 294.6 | 383.5 | 467.5 | 548.9 |
| 9 | 214.8 | 321.7 | 208.8 | 313.7 | 405.6 | 206 | 310.1 | 401.3 | 487.1 | 204.4 | 307.9 | 398.9 | 484.4 | 566.9 |
| 10 | 225 | 335.4 | 218.7 | 326.9 | 420.9 | 215.7 | 323 | 416.4 | 503.6 | 214 | 320.7 | 413.7 | 500.7 | 584.4 |

TABLE 6

| n | | 2 | 2 | 3 | 3 | 3 | 4 | 4 | 4 | 4 | 5 | 5 | 5 | 5 | 5 |
|---|---|---|---|---|---|---|---|---|---|---|---|---|---|---|---|
| ky | kx | 1 | 2 | 1 | 2 | 3 | 1 | 2 | 3 | 4 | 1 | 2 | 3 | 4 | 5 |
| | | | | | | | | (a) grid flatness rate r | | | | | | | |
| 1 | | 2.449 | 3.464 | 2.121 | 3 | 3.674 | 2 | 2.828 | 3.464 | 4 | 1.936 | 2.739 | 3.354 | 3.873 | 4.33 |
| 2 | | 1.732 | 2.449 | 1.5 | 2.121 | 2.598 | 1.414 | 2 | 2.449 | 2.828 | 1.369 | 1.936 | 2.372 | 2.739 | 3.062 |
| 3 | | 1.414 | 2 | 1.225 | 1.732 | 2.121 | 1.155 | 1.633 | 2 | 2.309 | 1.118 | 1.581 | 1.936 | 2.236 | 2.5 |
| 4 | | 1.225 | 1.732 | 1.061 | 1.5 | 1.837 | 1 | 1.414 | 1.732 | 2 | 0.968 | 1.369 | 1.677 | 1.936 | 2.165 |
| 5 | | 1.095 | 1.549 | 0.949 | 1.342 | 1.643 | 0.894 | 1.265 | 1.549 | 1.789 | 0.866 | 1.225 | 1.5 | 1.732 | 1.936 |
| 6 | | 1 | 1.414 | 0.866 | 1.225 | 1.5 | 0.816 | 1.155 | 1.414 | 1.633 | 0.791 | 1.118 | 1.369 | 1.581 | 1.768 |
| 7 | | 0.926 | 1.309 | 0.802 | 1.134 | 1.389 | 0.756 | 1.069 | 1.309 | 1.512 | 0.732 | 1.035 | 1.268 | 1.464 | 1.637 |
| 8 | | 0.866 | 1.225 | 0.75 | 1.061 | 1.299 | 0.707 | 1 | 1.225 | 1.414 | 0.685 | 0.968 | 1.186 | 1.369 | 1.531 |
| 9 | | 0.816 | 1.155 | 0.707 | 1 | 1.225 | 0.667 | 0.943 | 1.155 | 1.333 | 0.645 | 0.913 | 1.118 | 1.291 | 1.443 |
| 10 | | 0.775 | 1.095 | 0.671 | 0.949 | 1.162 | 0.632 | 0.894 | 1.095 | 1.265 | 0.612 | 0.866 | 1.061 | 1.225 | 1.369 |
| | | | | | | | | (b) tan θ | | | | | | | |
| 1 | | 0.408 | 0.577 | 0.471 | 0.667 | 0.816 | 0.5 | 0.707 | 0.866 | 1 | 0.516 | 0.73 | 0.894 | 1.033 | 1.155 |
| 2 | | 0.289 | 0.408 | 0.333 | 0.471 | 0.577 | 0.354 | 0.5 | 0.612 | 0.707 | 0.365 | 0.516 | 0.632 | 0.73 | 0.816 |
| 3 | | 0.236 | 0.333 | 0.272 | 0.385 | 0.471 | 0.289 | 0.408 | 0.5 | 0.577 | 0.298 | 0.422 | 0.516 | 0.596 | 0.667 |
| 4 | | 0.204 | 0.289 | 0.236 | 0.333 | 0.408 | 0.25 | 0.354 | 0.433 | 0.5 | 0.258 | 0.365 | 0.447 | 0.516 | 0.577 |
| 5 | | 0.183 | 0.258 | 0.211 | 0.298 | 0.365 | 0.224 | 0.316 | 0.387 | 0.447 | 0.231 | 0.327 | 0.4 | 0.462 | 0.516 |
| 6 | | 0.167 | 0.236 | 0.192 | 0.272 | 0.333 | 0.204 | 0.289 | 0.354 | 0.408 | 0.211 | 0.298 | 0.365 | 0.422 | 0.471 |
| 7 | | 0.154 | 0.218 | 0.178 | 0.252 | 0.309 | 0.189 | 0.267 | 0.327 | 0.378 | 0.195 | 0.276 | 0.338 | 0.39 | 0.436 |
| 8 | | 0.144 | 0.204 | 0.167 | 0.236 | 0.289 | 0.177 | 0.25 | 0.306 | 0.354 | 0.183 | 0.258 | 0.316 | 0.365 | 0.408 |
| 9 | | 0.136 | 0.192 | 0.157 | 0.222 | 0.272 | 0.167 | 0.236 | 0.289 | 0.333 | 0.172 | 0.243 | 0.298 | 0.344 | 0.385 |
| 10 | | 0.129 | 0.183 | 0.149 | 0.211 | 0.258 | 0.158 | 0.224 | 0.274 | 0.316 | 0.163 | 0.231 | 0.283 | 0.327 | 0.365 |
| | | | | | | | | (c) x-resolution 1/dx | | | | | | | |
| 1 | | 198.4 | 300 | 175.9 | 270.4 | 355.8 | 167.7 | 259.8 | 343.7 | 424.3 | 163.5 | 254.3 | 337.5 | 417.6 | 496.1 |
| 2 | | 270.4 | 396.9 | 237.2 | 351.8 | 450 | 225 | 335.4 | 430.8 | 519.6 | 218.7 | 326.9 | 420.9 | 508.7 | 592.9 |
| 3 | | 326.9 | 474.3 | 285.6 | 417.6 | 527.7 | 270.4 | 396.9 | 503.1 | 600 | 262.5 | 386.1 | 490.4 | 585.8 | 676 |
| 4 | | 375 | 540.8 | 326.9 | 474.3 | 595.3 | 309.2 | 450 | 566.2 | 670.8 | 300 | 437.3 | 551.1 | 653.8 | 750 |
| 5 | | 417.6 | 600 | 363.6 | 525 | 656 | 343.7 | 497.5 | 623 | 734.8 | 333.3 | 483.2 | 605.8 | 715.5 | 817.3 |
| 6 | | 456.2 | 653.8 | 396.9 | 571.2 | 711.5 | 375 | 540.8 | 675 | 793.7 | 363.6 | 525 | 656 | 772.2 | 879.5 |
| 7 | | 491.8 | 703.6 | 427.6 | 613.9 | 763 | 403.9 | 580.9 | 723.3 | 848.5 | 391.5 | 563.7 | 702.6 | 825 | 937.5 |
| 8 | | 525 | 750 | 456.2 | 653.8 | 811.2 | 430.8 | 618.5 | 768.5 | 900 | 417.6 | 600 | 746.2 | 874.6 | 992.2 |
| 9 | | 556.2 | 793.7 | 483.2 | 691.5 | 856.8 | 456.2 | 653.8 | 811.2 | 948.7 | 442.1 | 634.2 | 787.5 | 921.6 | 1044 |
| 10 | | 585.8 | 835.2 | 508.7 | 727.2 | 900 | 480.2 | 687.4 | 851.8 | 995 | 465.4 | 666.6 | 826.7 | 966.3 | 1093 |

TABLE T7(a)

| | | | | | | | | | | | | | | | |
|---|---|---|---|---|---|---|---|---|---|---|---|---|---|---|---|
| | | | | | | | | grid flatness rate r | | | | | | | |
| n | | 2 | 2 | 3 | 3 | 3 | 4 | 4 | 4 | 4 | 5 | 5 | 5 | 5 | 5 |
| ky | kx | 1 | 2 | 1 | 2 | 3 | 1 | 2 | 3 | 4 | 1 | 2 | 3 | 4 | 5 |
| 1 | | 1.414 | 2 | 1.342 | 1.897 | 2.324 | 1.309 | 1.852 | 2.268 | 2.619 | 1.291 | 1.826 | 2.236 | 2.582 | 2.887 |
| 2 | | 1 | 1.414 | 0.949 | 1.342 | 1.643 | 0.926 | 1.309 | 1.604 | 1.852 | 0.913 | 1.291 | 1.581 | 1.826 | 2.041 |
| 3 | | 0.816 | 1.155 | 0.775 | 1.095 | 1.342 | 0.756 | 1.069 | 1.309 | 1.512 | 0.745 | 1.054 | 1.291 | 1.491 | 1.667 |
| 4 | | 0.707 | 1 | 0.671 | 0.949 | 1.162 | 0.655 | 0.926 | 1.134 | 1.309 | 0.645 | 0.913 | 1.118 | 1.291 | 1.443 |
| 5 | | 0.632 | 0.894 | 0.6 | 0.849 | 1.039 | 0.586 | 0.828 | 1.014 | 1.171 | 0.577 | 0.816 | 1 | 1.155 | 1.291 |
| 6 | | 0.577 | 0.816 | 0.548 | 0.775 | 0.949 | 0.535 | 0.756 | 0.926 | 1.069 | 0.527 | 0.745 | 0.913 | 1.054 | 1.179 |
| 7 | | 0.535 | 0.756 | 0.507 | 0.717 | 0.878 | 0.495 | 0.7 | 0.857 | 0.99 | 0.488 | 0.69 | 0.845 | 0.976 | 1.091 |
| 8 | | 0.5 | 0.707 | 0.474 | 0.671 | 0.822 | 0.463 | 0.655 | 0.802 | 0.926 | 0.456 | 0.645 | 0.791 | 0.913 | 1.021 |
| 9 | | 0.471 | 0.667 | 0.447 | 0.632 | 0.775 | 0.436 | 0.617 | 0.756 | 0.873 | 0.43 | 0.609 | 0.745 | 0.861 | 0.962 |
| 10 | | 0.447 | 0.632 | 0.424 | 0.6 | 0.735 | 0.414 | 0.586 | 0.717 | 0.828 | 0.408 | 0.577 | 0.707 | 0.816 | 0.913 |

TABLE T7(b)

| | | | | | | | | | | | | | | | |
|---|---|---|---|---|---|---|---|---|---|---|---|---|---|---|---|
| | | | | | | | | tanθ | | | | | | | |
| n | | 2 | 2 | 3 | 3 | 3 | 4 | 4 | 4 | 4 | 5 | 5 | 5 | 5 | 5 |
| ky | kx | 1 | 2 | 1 | 2 | 3 | 1 | 2 | 3 | 4 | 1 | 2 | 3 | 4 | 5 |
| 1 | | 0.707 | 1 | 0.745 | 1.054 | 1.291 | 0.764 | 1.08 | 1.323 | 1.528 | 0.775 | 1.095 | 1.342 | 1.549 | 1.732 |
| 2 | | 0.5 | 0.707 | 0.527 | 0.745 | 0.913 | 0.54 | 0.764 | 0.935 | 1.08 | 0.548 | 0.775 | 0.949 | 1.095 | 1.225 |
| 3 | | 0.408 | 0.577 | 0.43 | 0.609 | 0.745 | 0.441 | 0.624 | 0.764 | 0.882 | 0.447 | 0.632 | 0.775 | 0.894 | 1 |
| 4 | | 0.354 | 0.5 | 0.373 | 0.527 | 0.645 | 0.382 | 0.54 | 0.661 | 0.764 | 0.387 | 0.548 | 0.671 | 0.775 | 0.866 |
| 5 | | 0.316 | 0.447 | 0.333 | 0.471 | 0.577 | 0.342 | 0.483 | 0.592 | 0.683 | 0.346 | 0.49 | 0.6 | 0.693 | 0.775 |
| 6 | | 0.289 | 0.408 | 0.304 | 0.43 | 0.527 | 0.312 | 0.441 | 0.54 | 0.624 | 0.316 | 0.447 | 0.548 | 0.632 | 0.707 |

TABLE T7(b)-continued

| | | tanθ | | | | | | | | | | | | | |
|---|---|---|---|---|---|---|---|---|---|---|---|---|---|---|---|
| n | | 2 | 2 | 3 | 3 | 3 | 4 | 4 | 4 | 4 | 5 | 5 | 5 | 5 | 5 |
| ky | kx | 1 | 2 | 1 | 2 | 3 | 1 | 2 | 3 | 4 | 1 | 2 | 3 | 4 | 5 |
| 7 | | 0.267 | 0.378 | 0.282 | 0.398 | 0.488 | 0.289 | 0.408 | 0.5 | 0.577 | 0.293 | 0.414 | 0.507 | 0.586 | 0.655 |
| 8 | | 0.25 | 0.354 | 0.264 | 0.373 | 0.456 | 0.27 | 0.382 | 0.468 | 0.54 | 0.274 | 0.387 | 0.474 | 0.548 | 0.612 |
| 9 | | 0.236 | 0.333 | 0.248 | 0.351 | 0.43 | 0.255 | 0.36 | 0.441 | 0.509 | 0.258 | 0.365 | 0.447 | 0.516 | 0.577 |
| 10 | | 0.224 | 0.316 | 0.236 | 0.333 | 0.408 | 0.242 | 0.342 | 0.418 | 0.483 | 0.245 | 0.346 | 0.424 | 0.49 | 0.548 |

TABLE T7(c)

| | | x-resolution 1/dx | | | | | | | | | | | | | |
|---|---|---|---|---|---|---|---|---|---|---|---|---|---|---|---|
| n | | 2 | 2 | 3 | 3 | 3 | 4 | 4 | 4 | 4 | 5 | 5 | 5 | 5 | 5 |
| ky | kx | 1 | 2 | 1 | 2 | 3 | 1 | 2 | 3 | 4 | 1 | 2 | 3 | 4 | 5 |
| 1 | | 129.9 | 212.1 | 125.5 | 206.8 | 284.6 | 123.6 | 204.4 | 282.1 | 358.6 | 122.5 | 203.1 | 280.6 | 357.1 | 433 |
| 2 | | 167.7 | 259.8 | 160.9 | 251 | 333.7 | 157.8 | 247.1 | 329.4 | 408.8 | 156.1 | 244.9 | 326.9 | 406.2 | 484.1 |
| 3 | | 198.4 | 300 | 189.7 | 288.5 | 376.5 | 185.9 | 283.5 | 370.7 | 453.6 | 183.7 | 280.6 | 367.4 | 450 | 530.3 |
| 4 | | 225 | 335.4 | 214.8 | 321.7 | 414.9 | 210.2 | 315.7 | 407.8 | 494.3 | 207.7 | 312.2 | 403.9 | 489.9 | 572.8 |
| 5 | | 248.7 | 367.4 | 237.2 | 351.8 | 450 | 232 | 344.9 | 441.9 | 531.8 | 229.1 | 341 | 437.9 | 526.8 | 612.4 |
| 6 | | 270.4 | 396.9 | 257.6 | 379.5 | 482.6 | 252 | 371.8 | 473.5 | 566.9 | 248.7 | 367.4 | 468.4 | 561.2 | 649.5 |
| 7 | | 290.5 | 424.3 | 276.6 | 405.3 | 513.1 | 270.4 | 396.9 | 503.1 | 600 | 266.9 | 392.1 | 497.5 | 593.7 | 684.7 |
| 8 | | 309.2 | 450 | 294.3 | 429.5 | 541.9 | 287.7 | 420.5 | 531.1 | 631.3 | 283.9 | 415.3 | 525 | 624.5 | 718.1 |
| 9 | | 326.9 | 474.3 | 311 | 452.5 | 569.2 | 304 | 442.8 | 557.7 | 661.2 | 300 | 437.3 | 551.1 | 653.8 | 750 |
| 10 | | 343.7 | 497.5 | 326.9 | 474.3 | 595.3 | 319.5 | 464.1 | 583 | 689.7 | 315.2 | 458.3 | 576.1 | 681.9 | 780.6 |

TABLE T8(a)

| | | grid flatness rate r | | | | | | | | | | | | | |
|---|---|---|---|---|---|---|---|---|---|---|---|---|---|---|---|
| n | | 2 | 2 | 3 | 3 | 3 | 4 | 4 | 4 | 4 | 5 | 5 | 5 | 5 | 5 |
| ky | kx | 1 | 2 | 1 | 2 | 3 | 1 | 2 | 3 | 4 | 1 | 2 | 3 | 4 | 5 |
| 0.5 | | | | 3.464 | 4.899 | 6 | 2.828 | 4 | 4.899 | 5.657 | 2.582 | 3.651 | 4.472 | 5.164 | 5.774 |
| 1 | | | | 2.449 | 3.464 | 4.243 | 2 | 2.828 | 3.464 | 4 | 1.826 | 2.582 | 3.162 | 3.651 | 4.082 |
| 1.5 | | | | 2 | 2.828 | 3.464 | 1.633 | 2.309 | 2.828 | 3.266 | 1.491 | 2.108 | 2.582 | 2.981 | 3.333 |
| 2 | | | | 1.732 | 2.449 | 3 | 1.414 | 2 | 2.449 | 2.828 | 1.291 | 1.826 | 2.236 | 2.582 | 2.887 |
| 2.5 | | | | 1.549 | 2.191 | 2.683 | 1.265 | 1.789 | 2.191 | 2.53 | 1.155 | 1.633 | 2 | 2.309 | 2.582 |
| 3 | | | | 1.414 | 2 | 2.449 | 1.155 | 1.633 | 2 | 2.309 | 1.054 | 1.491 | 1.826 | 2.108 | 2.357 |
| 3.5 | | | | 1.309 | 1.852 | 2.268 | 1.069 | 1.512 | 1.852 | 2.138 | 0.976 | 1.38 | 1.69 | 1.952 | 2.182 |
| 4 | | | | 1.225 | 1.732 | 2.121 | 1 | 1.414 | 1.732 | 2 | 0.913 | 1.291 | 1.581 | 1.826 | 2.041 |
| 4.5 | | | | 1.155 | 1.633 | 2 | 0.943 | 1.333 | 1.633 | 1.886 | 0.861 | 1.217 | 1.491 | 1.721 | 1.925 |
| 5 | | | | 1.095 | 1.549 | 1.897 | 0.894 | 1.265 | 1.549 | 1.789 | 0.816 | 1.155 | 1.414 | 1.633 | 1.826 |

TABLE T8(b)

| | | tanθ | | | | | | | | | | | | | |
|---|---|---|---|---|---|---|---|---|---|---|---|---|---|---|---|
| n | | 2 | 2 | 3 | 3 | 3 | 4 | 4 | 4 | 4 | 5 | 5 | 5 | 5 | 5 |
| ky | kx | 1 | 2 | 1 | 2 | 3 | 1 | 2 | 3 | 4 | 1 | 2 | 3 | 4 | 5 |
| 0.5 | | | | 0.577 | 0.816 | 1 | 0.707 | 1 | 1.225 | 1.414 | 0.775 | 1.095 | 1.342 | 1.549 | 1.732 |
| 1 | | | | 0.408 | 0.577 | 0.707 | 0.5 | 0.707 | 0.866 | 1 | 0.548 | 0.775 | 0.949 | 1.095 | 1.225 |
| 1.5 | | | | 0.333 | 0.471 | 0.577 | 0.408 | 0.577 | 0.707 | 0.816 | 0.447 | 0.632 | 0.775 | 0.894 | 1 |
| 2 | | | | 0.289 | 0.408 | 0.5 | 0.354 | 0.5 | 0.612 | 0.707 | 0.387 | 0.548 | 0.671 | 0.775 | 0.866 |
| 2.5 | | | | 0.258 | 0.365 | 0.447 | 0.316 | 0.447 | 0.548 | 0.632 | 0.346 | 0.49 | 0.6 | 0.693 | 0.775 |
| 3 | | | | 0.236 | 0.333 | 0.408 | 0.289 | 0.408 | 0.5 | 0.577 | 0.316 | 0.447 | 0.548 | 0.632 | 0.707 |
| 3.5 | | | | 0.218 | 0.309 | 0.378 | 0.267 | 0.378 | 0.463 | 0.535 | 0.293 | 0.414 | 0.507 | 0.586 | 0.655 |
| 4 | | | | 0.204 | 0.289 | 0.354 | 0.25 | 0.354 | 0.433 | 0.5 | 0.274 | 0.387 | 0.474 | 0.548 | 0.612 |
| 4.5 | | | | 0.192 | 0.272 | 0.333 | 0.236 | 0.333 | 0.408 | 0.471 | 0.258 | 0.365 | 0.447 | 0.516 | 0.577 |
| 5 | | | | 0.183 | 0.258 | 0.316 | 0.224 | 0.316 | 0.387 | 0.447 | 0.245 | 0.346 | 0.424 | 0.49 | 0.548 |

TABLE T8(c)

| | | x-resolution 1/dx | | | | | | | | | | | | | |
|---|---|---|---|---|---|---|---|---|---|---|---|---|---|---|---|
| n | | 2 | 2 | 3 | 3 | 3 | 4 | 4 | 4 | 4 | 5 | 5 | 5 | 5 | 5 |
| ky | kx | 1 | 2 | 1 | 2 | 3 | 1 | 2 | 3 | 4 | 1 | 2 | 3 | 4 | 5 |
| 0.5 | | | | 150 | 237.2 | 318.2 | 129.9 | 212.1 | 290.5 | 367.4 | 122.5 | 203.1 | 280.6 | 357.1 | 433 |
| 1 | | | | 198.4 | 300 | 389.7 | 167.7 | 259.8 | 343.7 | 424.3 | 156.1 | 244.9 | 326.9 | 406.2 | 484.1 |
| 1.5 | | | | 237.2 | 351.8 | 450 | 198.4 | 300 | 389.7 | 474.3 | 183.7 | 280.6 | 367.4 | 450 | 530.3 |
| 2 | | | | 270.4 | 396.9 | 503.1 | 225 | 335.4 | 430.8 | 519.6 | 207.7 | 312.2 | 403.9 | 489.9 | 572.8 |
| 2.5 | | | | 300 | 437.3 | 551.1 | 248.7 | 367.4 | 468.4 | 561.2 | 229.1 | 341 | 437.3 | 526.8 | 612.4 |
| 3 | | | | 326.9 | 474.3 | 595.3 | 270.4 | 396.9 | 503.1 | 600 | 248.7 | 367.4 | 468.4 | 561.2 | 649.5 |
| 3.5 | | | | 351.8 | 508.7 | 636.4 | 290.5 | 424.3 | 535.6 | 636.4 | 266.9 | 392.1 | 497.5 | 593.7 | 684.7 |
| 4 | | | | 375 | 540.8 | 675 | 309.2 | 450 | 566.2 | 670.8 | 283.9 | 415.3 | 525 | 624.5 | 718.1 |
| 4.5 | | | | 396.9 | 571.2 | 711.5 | 326.9 | 474.3 | 595.3 | 703.6 | 300 | 437.3 | 551.1 | 653.8 | 750 |
| 5 | | | | 417.6 | 600 | 746.2 | 343.7 | 497.5 | 623 | 734.8 | 315.2 | 458.3 | 576.1 | 681.9 | 780.6 |

When the deflection number n equals the variable kx, no multiple ejection is performed.

Figure 12A:
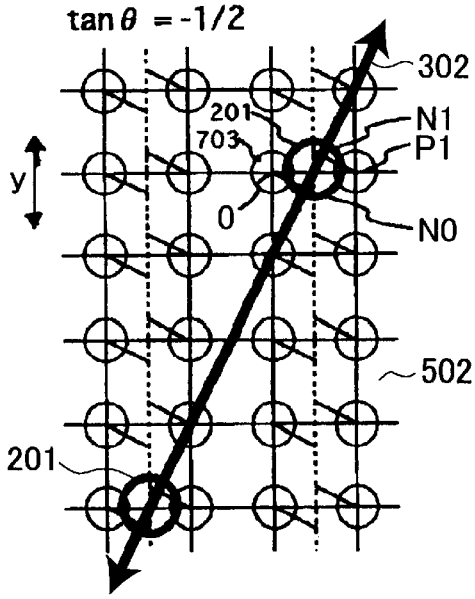
FIG. 12(*a*) is an explanatory view of an example of printing operation for when an impact position is (dx, 0)
Figure 12B:
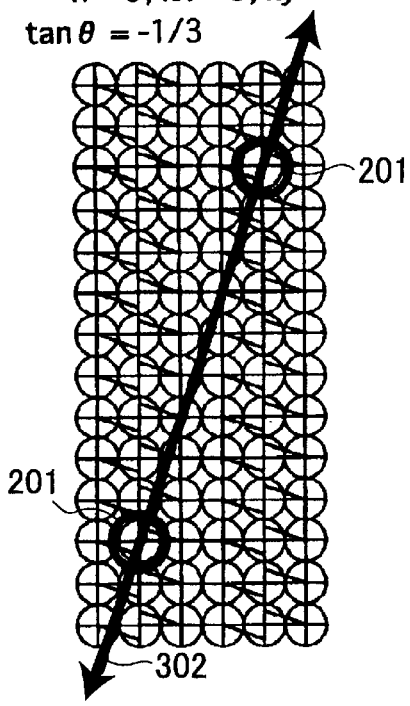
Figure 12C:
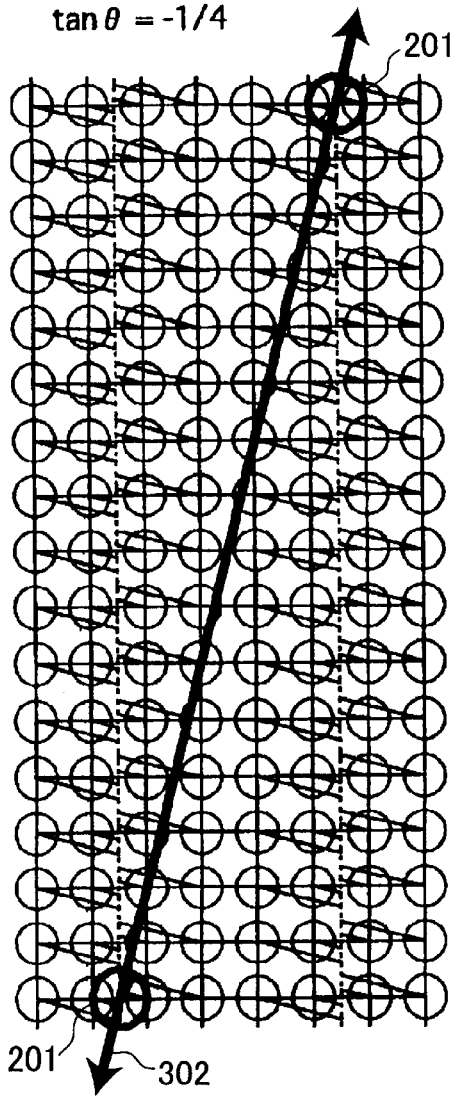
Figure 13A:
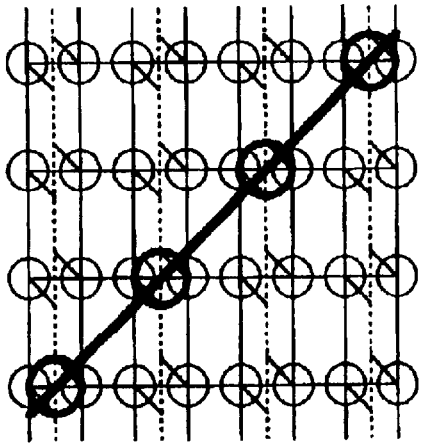
FIG. 13(*a*) is an explanatory view of another example of printing operation for when the impact position is (dx, 0)
Figure 13C:
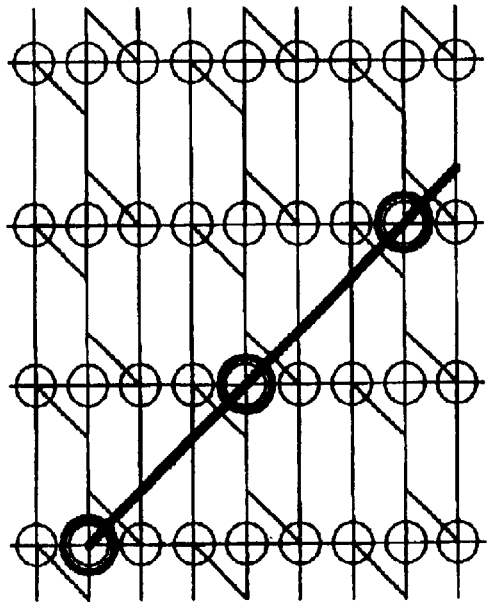
Figure 13B:
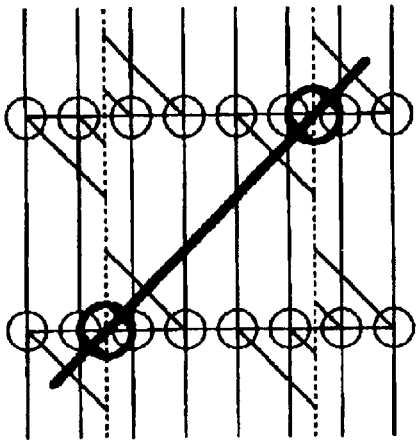
Figure 13D:
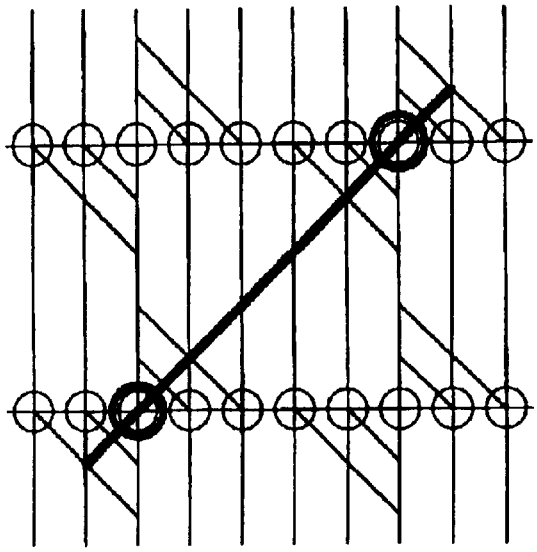
Figure 14A:
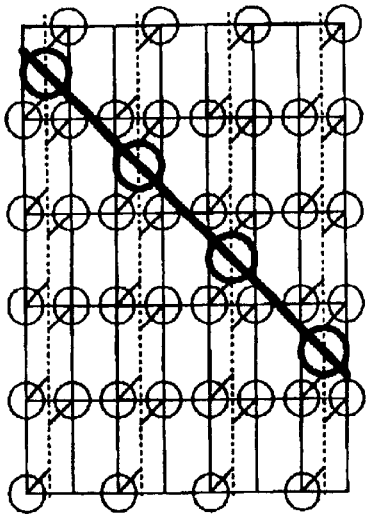
FIG. 14(*a*) is an explanatory view of an example of printing operation for when the impact position is (dx, dy)
Figure 14B:
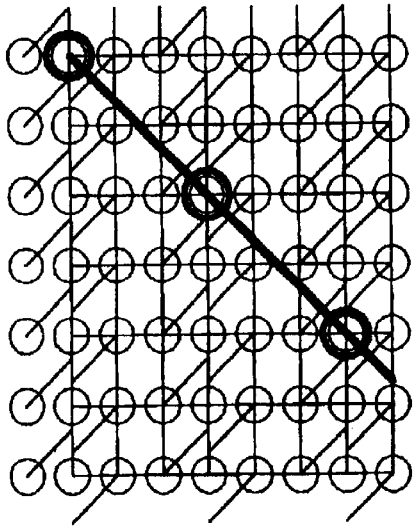
Figure 14C:
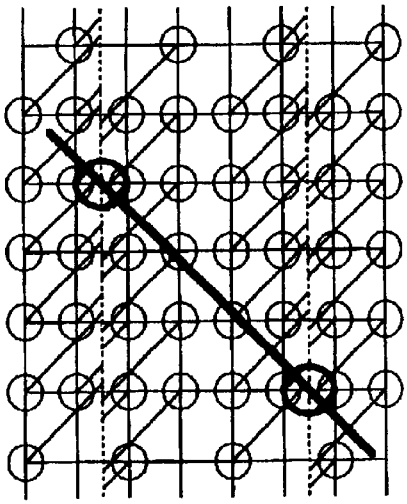
Figure 14D:
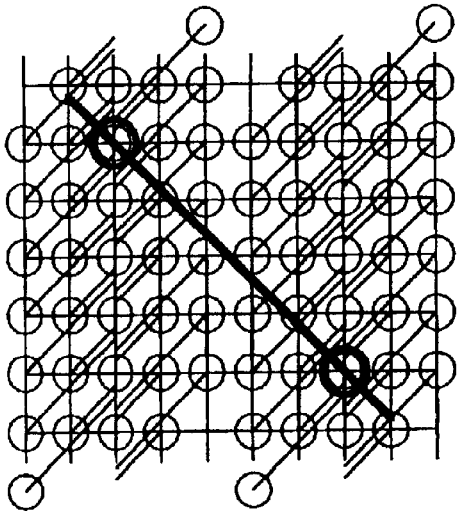
Figure 15A:
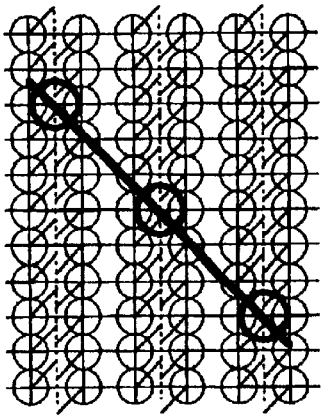
FIG. 15(*a*) is an explanatory view of an example of printing operation for when the impact position is (dx, 2dy)
Figure 15C:
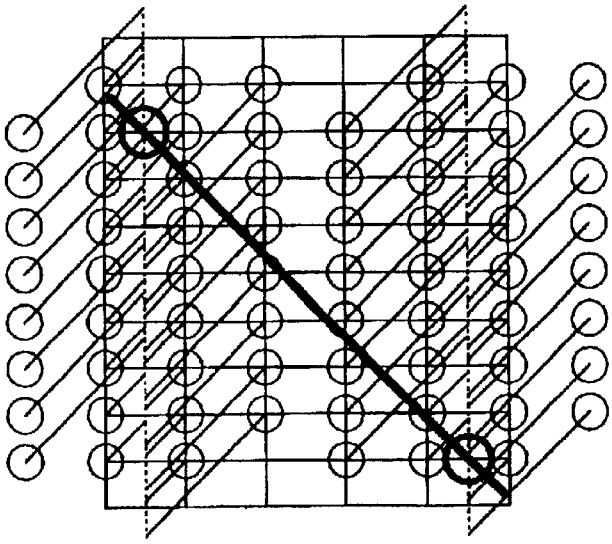
Figure 15B:
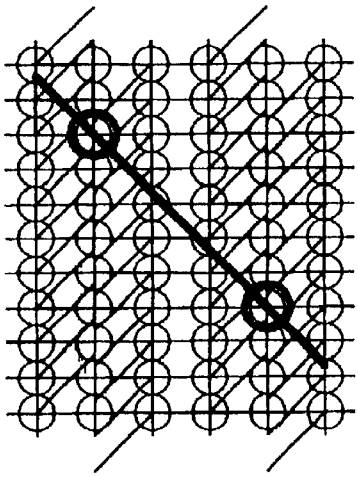
Figure 15D:
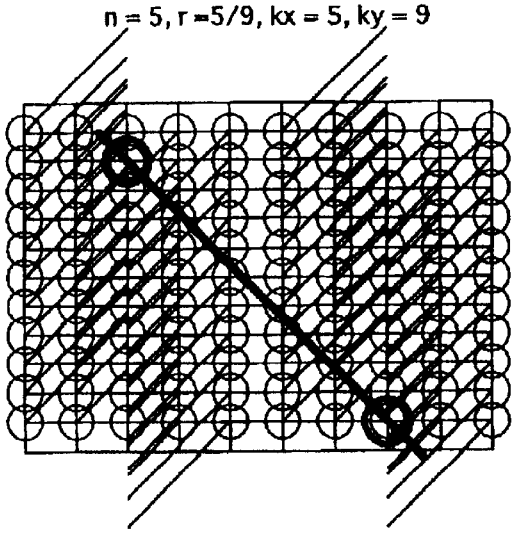

FIG. 12 shows ink ejection operations for when the position P1 is the position P1*a* (1·dx, 0·dy). In this case, the grid squareness rate r is $((kx/ky)\cdot n)^{0.5}$, according to the above equations Eq3.

Referring to the table T1(*a*), nozzle structures that satisfy the requirements of both the grid squareness rate r−=1 and the n=kx, i.e., the grid 704 is in square shape and no-multiple ejection is performed, are searched out as a first example. As will be understood from the table T1(*a*), only one nozzle structure is searched for each deflection number n, and FIGS. 12(*a*), 12(*b*), and 12(*c*) are explanatory views of operations for when the deflection number n equals 2, 3, and 4, respectively, each indicating the inclination θ of the orifice-line direction 302, the ejection position of the orifice 201, the ejection timing, the deflection direction DD, and the impact position 703.

In FIG. 12(*a*), two adjacent orifices 201 are shown. The orifices 201 are positioned above the recording sheet 502 and move in the y direction relative to and parallel to the recording sheet 502 while maintaining the inclination θ constant. A moving path of the center of each orifice 201 is indicated by a dotted line, on which the orifice 201 moves downward in FIG. 12(*a*). It should be noted that although FIG. 12(*a*) accurately shows the positions of the orifice 201 relative to the impact positions 703, the relative sizes are different from the actual ones. In this explanation, right upper one of the orifices 201 in FIG. 12(*a*) will be described.

When the orifice 201 is at an ejection position NO, an ejected ink droplet 501 is deflected leftward in FIG. 12(*a*), and impacts on a position 0 on the grid corner 704*a*. When half the ejection cycle is passed, i.e., when the orifice 201 moves from the ejection position N0 to N1 by a distance of dy/2, an ejected ink droplet 501 is deflected rightward and impacts on the position P1 on the grid corner 704*a*. When the position 0 is the original P0, then the position P1 is the position P1*a* (1·dx, 0·dy).

When another half the ejection cycle is passed, and when the orifice 201 is moved by a distance of another dy/2, one ejection cycle is completed. Then, the same process is repeatedly performed.

This is also true for the lower left one of the orifices 201 in FIG. 12(*a*) although the lower left orifice 201 is positioned below the upper right orifice 201 by a 4-dot-worth of distance.

Because the same is true for FIGS. 12(*b*) and 12(*c*), explanations will be omitted in order to avoid duplication in explanation.

Also, when the deflection number n=2, 3, and 4, it is understood from the tables T1(*b*) and T1(*c*) that the corresponding values of tan θ are ½, ⅓, and ¼, and that the x-resolution 1/dx is 335 dpi (tan θ=½), 712 dip (tan θ=⅓), and 1,237 dpi (tan θ=¼), respectively.

In the present first example, because the grid squareness rate r is 1, the grids 704 are in the desirable square shape. Also, because the variable kx equals the deflection number n, no multiple ejection is performed, so the orifices 201 are utilized efficiently. However, the requirements of this first example are relatively strict, so there is only one nozzle structure available for each deflection number n as described above, and there is no alternative. Further, when a printing width is 17 inches for example, the number of required nozzles 201 will be 2,848 nozzles for the deflection number n=2, 4,035 nozzles for the n=3, and 5,257 nozzles for the deflection number n=4.

It should be noted that these nozzle numbers are obtained by dividing the number of the scanning lines 110 by the deflection number n. Therefore, even when the deflection number n is increased in the purpose of reducing nozzles 201, required nozzles 201 do not decrease although the resolution of images is increased.

In order to provide a choice of the nozzle structure, the requirement of the grid squareness rate r may be relaxed.

In a second example, the requirement of tan θ=1 is used rather than r=1 so that the inclination θ is greater than when r=1. Details will be described next.

Nozzle structures that satisfy both the requirements of the deflection number n=kx and tan θ=1 are searched out from the table T1(*b*). As shown in the tables T1(*a*) and T1(*c*), when the deflection number n=2, 3, 4, and 5, then the grid squareness rate r is 2, 3, 4, and 5, and the x-resolution 1/dx is 212 dpi, 318 dpi, 424 dpi, and 530 dpi, respectively. The y-resolution 1/dy is 106 dpi (=1/r·dx) in all the cases. FIGS. 13(*a*), 13(*b*), 13(*c*), and 13(*d*) correspond to the deflection number n of 2, 3, 4, and 5.

Inaccuracy assembly of the orifice lines 107*b* and the common electrodes 401, 402 easily shifts the impact positions 703 in the x direction and so the impact positions 703. The nozzle structure of the second example can correct such impact positions 703 that are slightly shifted in the x direction.

Next, a third example will be described while referring to FIGS. 14(*a*) through 14(*d*) and the tables T2(*a*) through T2(*c*). The position P1 is shifted in the y direction to the position P1*b* (1·dx, 1·dy) in this example. Although in the above second example there are difference between the x-resolution 1/dx and the y-resolution 1/dy, according to the third example the resolutions 1/dx , 1/dy are balanced. The grid squareness rate $r=((kx/ky)\cdot(n/(n-1)))^{0.5}$.

Referring to the tables T2(*a*) through T2(*c*), under the requirements of n=kx and θ=1, the x-resolution 1/dx is 212 dpi, 318 dpi, 424 dpi, 530 dpi and the grid flatness rate r is 2, 3/2, 4/3, 5/4 when the deflection number n is 2, 3, 4, 5, respectively. Accordingly, the y-resolution 1/dy is 106 dpi, 212 dpi, 318 dpi, 424 dpi, respectively (=1/r·dx). FIGS. 14(*a*) through 14(*d*) corresponds to the deflection number of 2, 3, 4, 5, respectively.

In comparison with the second example, the grid flatness rate r is the same when the deflecting number n is 2. However, the grid flatness rate r of the third example is closer to 1 than that of the second example when the deflection number is 3, 4, or 5. That is, the shape of the grids 704 is closer to square, so the difference between the x-resolution and the y-resolution of images is desirably reduced.

In a next forth example, the position P1 is further moved in the x direction to the position P1*c* (1·dx, 2·dy) As shown in the Tables T3(*a*) through T3(*c*), under the requirement of tan θ=1 and n=kx, the grid squareness rate r is 2/3, 3/5, 4/7, 5/9, and the x-resolution 1/dx is 212 dpi, 318 dpi, 424 dpi, 530 dpi when the deflection number n is 2, 3, 4, and 5, respectively. Accordingly, the y-resolution 1/dy is 318 dpi, 530 dpi, 742 dpi, 954 dpi, respectively.

That is, the y-resolution 1/dy is greater than the x-resolutions 1/dx. This contrasts to the above second example shown in FIGS. 13(*a*) to 13(*d*). FIGS. 15(*a*) to 15(*d*) show the operations for when n=2, n=3, n=4, and n=5, respectively.

As described above, when the requirement of r=1 is relaxed and the position P1 is shifted in the y direction, the x and y resolutions 1/dx and 1/dy are balanced, and also a few choice of x-resolution 1/dy is provided.

Figure 16:
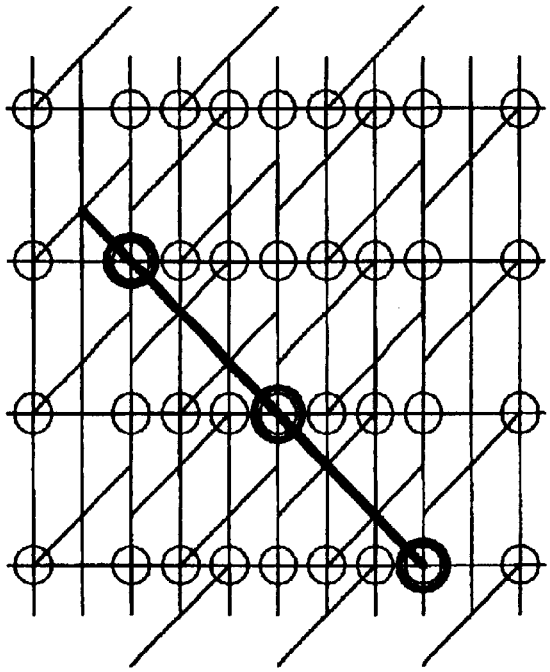
FIG. 16 is an explanatory view of an example of printing operation for when the impact position is (2dx, 1dy)

Next, a fifth example will be described while referring to FIG. 16 and the tables T4(*a*) through T4(*b*). In the present example also the requirement of r=1 is relaxed. In addition, the position P is shifted in the x direction also to the position P1*d* (2·dx, 1·dy). The grid squareness rate $r=((kx/ky)\cdot(2n/(n-1)))^{0.5}$ according to the equations Eq3.

According to the tables T4(*a*) through T4(*b*), when the deflection number n is 3, the grid flatness rate r is 3, and the x-resolution 1/dx is 318 dpi, under the requirements of tan θ=1 and n=kx. Accordingly, the y-resolution 1/dy is 106 dpi. FIG. 16 shows an ejection operation for this case. That is, the x and y resolutions of images are the same as those of the second embodiment shown in FIG. 13(*b*). However, the impact positions with respect to the y-scanning lines 702 differ between the present example and the second example.

Specifically, in FIG. 13(*b*), the ink droplets 501 ejected from a single orifice 201 impact on three nearest y-canning lines 702. On the other hand, in FIG. 16, ink droplets 501 from a single orifice 201 impact every other y-direction scanning lines 702, and ink droplets 501 from neighboring orifices 201 impact on y-scanning lines 702 where the ink droplets 501 from the single orifice 201 does not impact. That is, a plurality of y-scanning lines 702 allocated to a single orifice 201 are dispersed. This ejection method is referred to as "dispersed deflection recording".

The dispersed deflection recording reduces undesirable effects due to unevenness in characteristics of the nozzles 107*a*. Specifically, when characteristics of one nozzle 107*a* differs from surrounding nozzles 107*a* for example, recording condition on three y-scanning lines 702 allocated to the one nozzle 107*a* differs from that of remaining neighboring y-scanning lines 702. When the three y-scanning line 702 are positioned side by side as in the example of FIG. 13(*b*), unevenness in the recording condition is easily recognized. On the other hand, when the three y-scanning lines 702 are separated without being side by side as shown in FIG. 16, uneven recording condition is less recognizable, so overall printing quality is improved.

Figure 17:
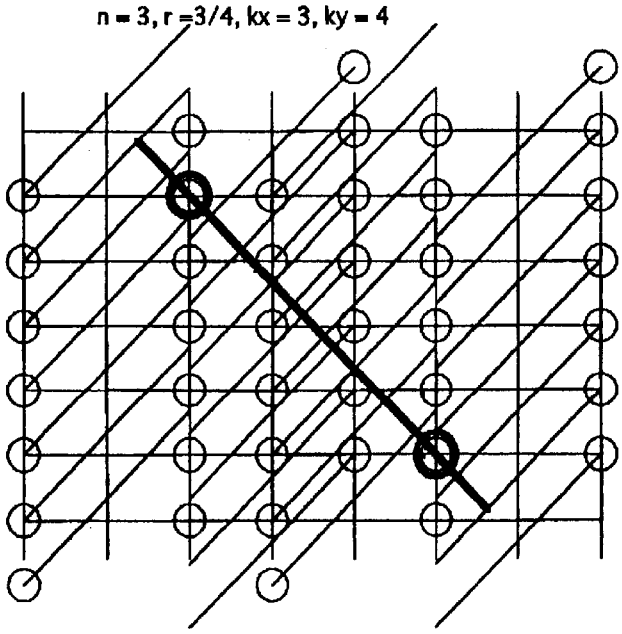
FIG. 17 is an explanatory view of an example of printing operation for when the impact position is (2dx, 3dy)

FIG. 17 shows a sixth example where the position P1 is further shifted in the y direction to the position P1*e* (2·dx, 3·dy). The requirements are tan θ=1 and n=kx. In this case, the grid squareness rate $r=((kx/ky)\cdot(2n/(3n-1)))^{0.5}$. As shown in the tables T5(*a*) through T5(*c*), when the deflection number n is 3, the grid squareness rate r is 3/4,and the x-resolution 1/dx is 318 dpi. Accordingly, the y-resolution 1/dy is 424 dpi, which is higher than y-resolution of the fifth example. That is, the y-resolution can be increased in the same manner as in the fifth example by shifting the position p in the y direction.

Figure 18:
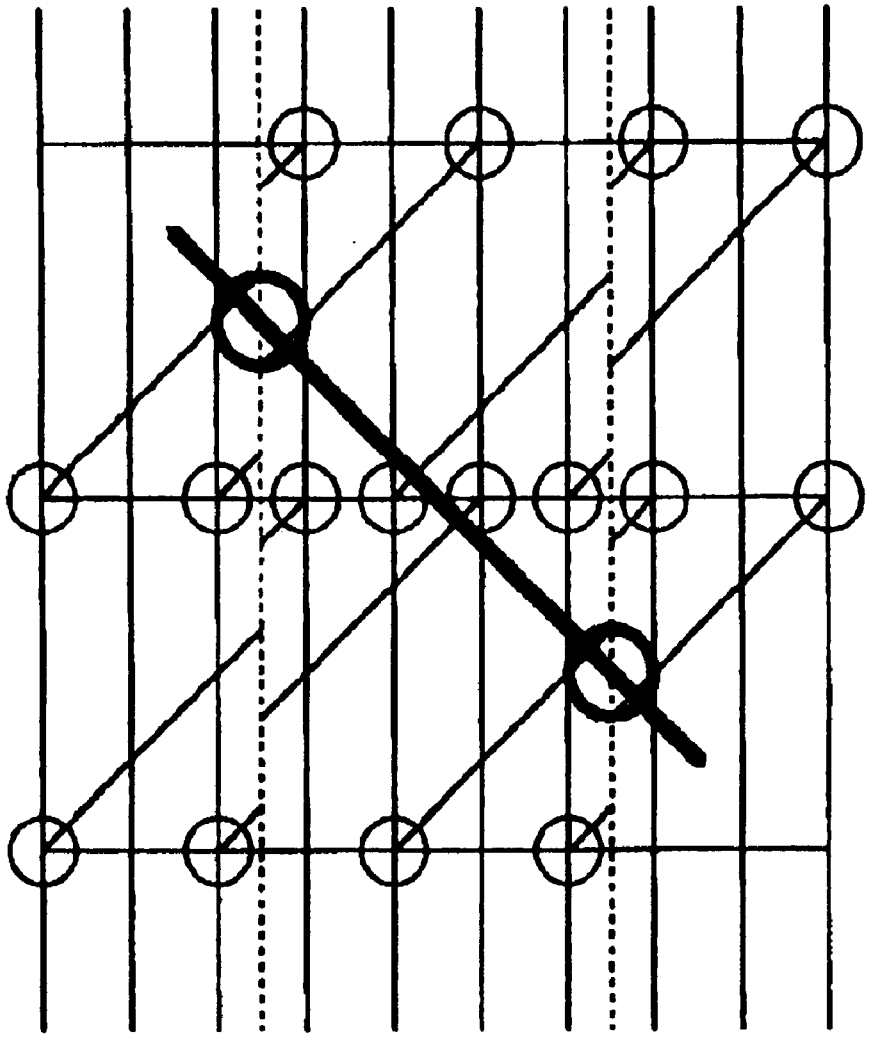
FIG. 18 is an explanatory view of an example of printing operation for when the impact position is (3dx, 1dy)

FIG. 18 shows a seventh example where the position P1 is moved to P1*f* (3·dx, 1·dy). The grid squareness rate r is $((kx/ky)\cdot(3n/(n-1)))^{0.5}$ in this case. The requirements are tan θ=1 and n=kx. As shown in the tables T6(*a*) through T6(*c*), when the deflection number n is 4, the grid squareness rate r is 4, and the x-resolution 1/dx is 424 dpi. The y-resolution 1/dy is 106 dpi, and the dispersed deflection recording is performed.

Figure 19A:
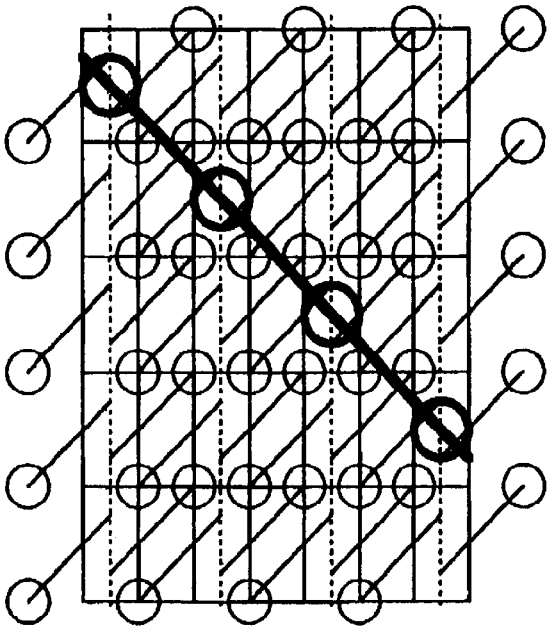
FIG. 19(*a*) is an explanatory view of an example of printing operation for when the impact position is (3dx, 2dy)
Figure 19B:
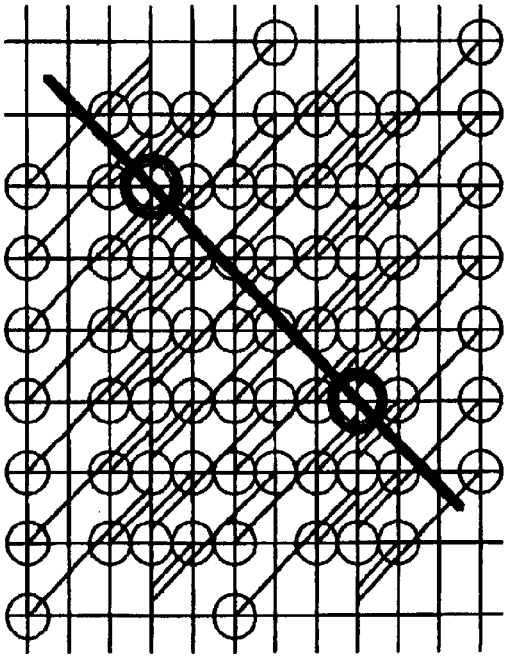
Figure 20A:
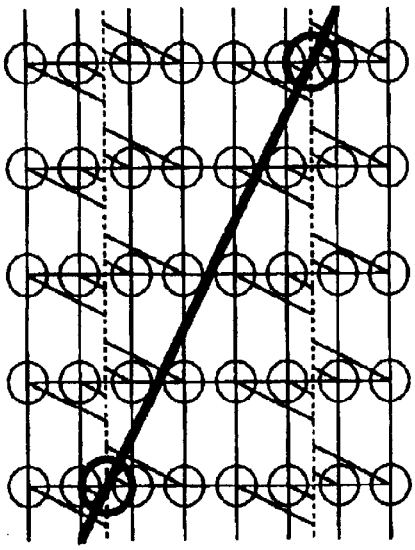
FIG. 20(*a*) is an explanatory view of another example of printing operation for when the impact position is (dx, 0)
Figure 20B:
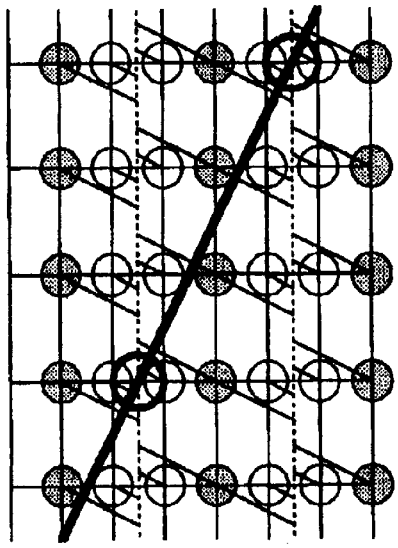
Figure 20C:
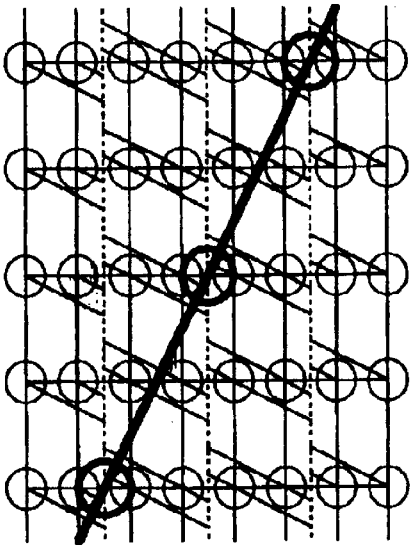
Figure 20D:
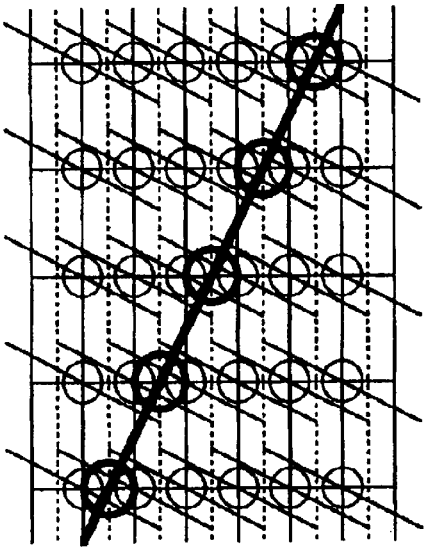
Figure 21A:
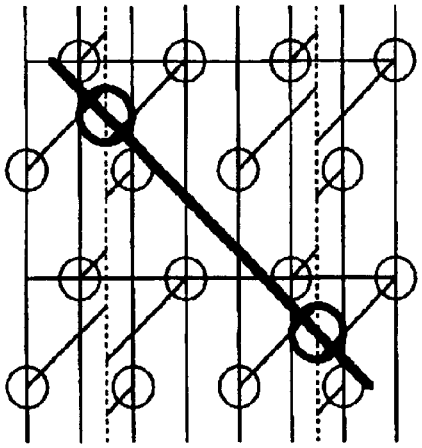
FIG. 21(*a*) is an explanatory view of another example of printing operation for when the impact position is (dx, 0.5dy)
Figure 21B:
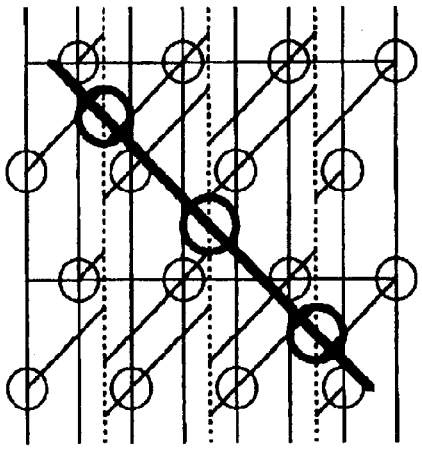
Figure 21C:
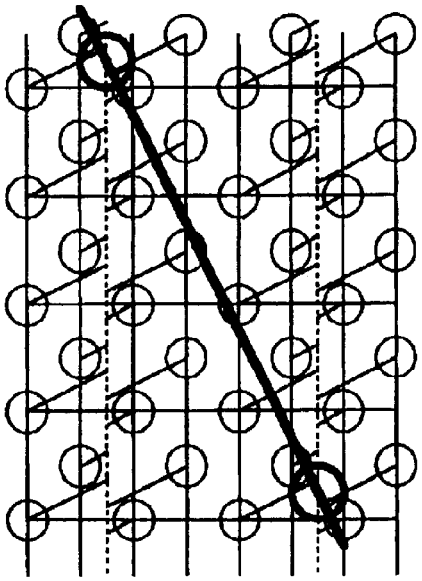
Figure 21D:
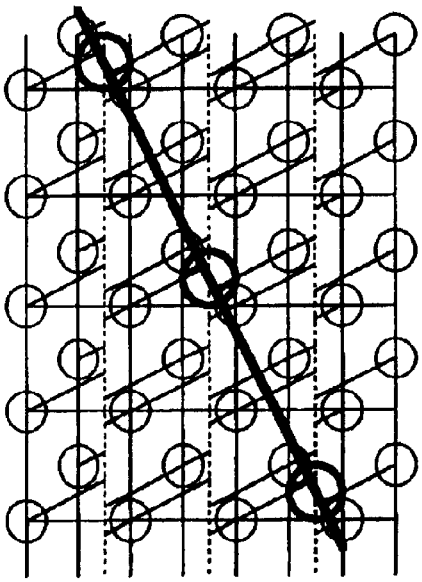

FIGS. 19(*a*) and 19(*b*) show an eighth example where the position P1 is the position P1*g* (3·dx, 2·dy). In this case, the grid squareness rate r is $((kx/ky)\cdot(3n/(2n-1)))^{0.5}$ according to the equations Eq3. The requirements are tan θ=1 and n=kx. As shown in the tables T7(*a*) through T7(*c*), when the deflection number n is 2, the grid squareness rate r is 2, and the x-resolution 1/dx is 212 dpi. The y-resolution 1/dy is 106 dpi. On the other hand, when the deflection number n is 5, then the grid squareness rate r is ⅝, x-resolution 1/dx is 530 dpi, and the y-resolution 1/dy is 318 dpi. FIGS. 19(*a*) and 19(*b*) are for n=2 and n=5, respectively. The dispersed deflection recording is performed both when n=2 and n=5.

As described above, the dispersed deflecting recording can be performed with variety of deflection number n. Therefore, a suitable deflection number n can be selected among different deflection numbers n.

FIGS. 20(*a*) through 20(*d*) show a ninth example where the position P1 is the position P1*a* (1·dx, 0·dy), the deflection number n=4, and the grid flatness rate r=1. The value of tan θ is ¼. Although in the first to eighth example the deflection number n=kx, in the present example the deflection number n>=kx. That is, the requirement of n=1 is released so that multiple printing can be performed.

FIGS. 20(*a*) to 20(*d*) correspond to when kx=4, kx=3, kx=2, and kx=1, respectively.

In FIG. 20(*a*), because the variable kx=4, then the variable k=n. Therefore, no-multiple ejection is performed. On the other hand, n>kx in FIGS. 20(*b*) to 20(*d*) where the multiple ejection is performed.

Specifically, when kx=3 as shown in FIG. 12(*b*), each of dots indicated by hatching is formed from by two ink droplets 501 ejected from different orifices 201 at a different timing, and each of remaining dots is formed by a single ink droplet 501. This printing method is referred to as "partially-double-ejection method".

In FIG. 20(*c*), kx=2, where every dot is formed by two ink droplets 501 ejected from different orifices 201 at a different timing. This method is referred to as "all-double-ejection method". In FIG. 20(*d*), kx=1, where every dot is formed by four ink droplets 501 ejected from four different orifices 201 at a different timing. This method is referred to as "all-quadruple-ejection method".

The multiple ejection method adjusts the printing conditions even when the characteristics of the nozzles 107*a* are uneven. Therefore, undesirable line due to the uneven nozzle characteristics will not appear on the printed image, so quality of the image is improved. By using saturation type ink, color density will be uniform between dots formed by the single ejection and dots formed by the multiple ejection. This prevents degradation of image quality even when some nozzles 107*a* become inoperative during printing, as long as the multiple ejection method is used, and reliability of the recording head 107 increases.

Although the reliability of the recording head 107 is further improved by increasing the number of ejections for a single dot, increase of the number of ejections decreases the resolution. For example, as shown in the table T1(*c*), the x-resolution is 503 dpi, 335 dpi, 168 dpi when kx=3, kx=2, kx=1, respectively, which are smaller than the x-resolution 1/dx of 671 dpi obtained when kx=4=n where no multiple printing is performed. Because techniques for changing the resolution has been proposed and available in technical use, a user may choose a desired resolution as needed.

Next, a tenth example will be described. In the above first to ninth examples the impact positions 703 are controlled to be on the grid corners 704*a* of the x-y rectangular coordinate system. However, in the present example, the grid corners will be on non-rectangular coordinate system defining a honeycomb-like pattern.

Details will be described while referring to the table T8(*a*) through T8(*c*) and FIGS. 11 and 21(*a*) through 21(*d*).

Figure 11:
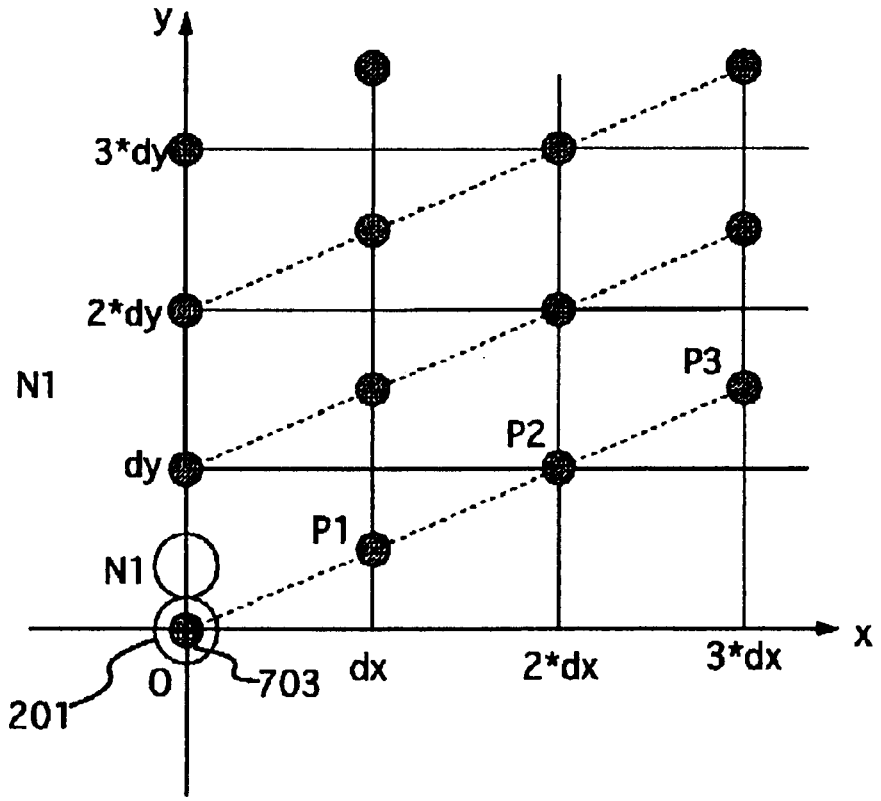
FIG. 11 is an explanatory view showing impact positions.

FIG. 11 shows a position p1 satisfying the above first to fourth conditions. As will be understood from FIG. 11, the position P1 has the coordinate value of (1·dx, ½·dy) That is, the position P1 is shifted to a position (1·dx, ½·dy), the grid flatness rate r is $((kx/ky)\cdot(2n/(n-2)))^{0.5}$ according to the equations Eq3.

In FIGS. 21(*a*) through 21(*d*), the deflection number n=4. In FIGS. 21(*a*) and 21(*b*), tan θ=1. In FIGS. 21(*c*) and 21(*d*), tan θ=½. In FIGS. 21(*a*) and 21(*c*), n=kx, that is, no multiple ejection is performed. In FIGS. 21(*b*) and 21(*d*), the all-double-ejection recording is performed. In FIGS. 21(*a*) and 21(*b*), dots are formed on the x-scanning lines and y-scanning lines of 212 dpi and 106 dpi, respectively, and in the center of each grid. In FIGS. 21(*c*) and 21(*d*), dots are formed on the x-scanning lines and y-scanning lines of 335 dpi and 335 dpi, respectively, and in the center of each grid.

Although the x-resolutions are shown in the tables T8(*c*) and the y-resolutions can be obtained through calculations, because the non-rectangular coordinate system defining the honeycomb-like pattern where additional dots are formed in the center of each grid defined by the x-scanning and y-scanning lines, the actual resolutions are higher than that.

Usually, ink droplets 501 form circular dots on the recording sheet 502. Therefore, when dots are formed in the honeycomb pattern as in the present example on every target positions, overlapping regions of and gaps between adjacent dots will be less compared to when dots are formed on the rectangular coordinate system. When adjacent dots are arranged in an equilateral triangle, the overlapping regions and the gaps will be least. This enables the ink to uniformly cling on the recording sheet 502 when all-black image is formed, and so reduces ink consumption and prevents degradation in image quality due to blurring or ink flow on the recording sheet 502. Further, the ink is prevented from appearing on a back surface of the recording sheet 502.

As described above, according to the present invention, the electrodes for generating the charging electric field and the deflector electric field can be provided common to all nozzles in a single orifice line. This configuration provides a highly reliable multi-nozzle print head. Also, because the ejection time interval is uniform in all the ink droplets to be deflected, the printing is performed at a maximum speed available for the nozzles. The multiple ejection increases the reliability as needed. Further, forming dots on the honeycomb-like pattern reduces ink consumption by reducing overlapping regions and gaps between adjacent circular dots.

While some exemplary embodiments of this invention have been described in detail, those skilled in the art will recognize that there are many possible modifications and variations which may be made in these exemplary embodiments while yet retaining many of the novel features and advantages of the invention.

Although in the above-described embodiment, the orifices 201 are aligned in the pitch of 75 orifices/inch, the nozzles 107*a* can be aligned in the pitch of 150 orifices/inch. In this case, a resolution will be twice the above-described resolution. Also, the number of nozzles 107*a* (orifices 201 ) is not limited to 128.

Also, the present invention can be also applied to an ink jet recording device where printing is performed while a recording head is moved and a recording sheet stays still rather than where the printing is performed while the recording sheet is moved and the recording sheet stays still.

Further, the present invention can also be applied to bubble jet recording device where an air bubble is generated by applying head, and ejecting ink by utilizing the pressure of the generated air bubble.

What is claimed is:

1. A multi-nozzle ink jet recording device comprising:

a print head formed with an orifice line extending in a line direction and including a plurality of orifices aligned at a uniform pitch;

ejection means for ejecting ink droplets through the plurality of orifices, the ink droplets having a uniform shape and being separated from one another;

a pair of electrodes common to all the plurality of orifices;

generating means for generating a charging electric field and a deflecting electric field at the same time by applying a voltage to the pair of electrodes, the charging electric field being generated near the orifices, having a magnitude that changes at an ink-ejection frequency, and charging the ink droplets, the deflecting electric field having a constant magnitude and deflecting a flying direction of the ink droplets; and ejection/deflecting controlling means for controlling the ejection means to eject the ink droplets at a uniform ejection interval onto all grid corners of grids in a coordinate system defined on a recording medium having a width in a widthwise direction and a length in a lengthwise direction perpendicular to the widthwise direction.

2. The multi-nozzle ink jet recording device according to claim 1, wherein the orifice line has an angle θ with respect to the lengthwise direction, and the ejection/deflection means controls the ink-ejection frequency and the magnitude of the charging electric field in accordance with the angle θ of the orifices line, the pitch of the orifices, and a deflection number.

3. The multi-nozzle ink jet recording device according to claim 2, wherein the generating means applies the voltage, whose waveform changes at the ink-ejection frequency, to the pair of electrodes such that the charging electric field changes the magnitude accordingly, and the ejection/deflection means controls the waveform of the voltage applied to the pair of electrodes so as to control the charging electric field.

4. A multi-nozzle ink jet recording device comprising:

a print head formed with an orifice line extending in a line direction and including a plurality of orifices aligned at a uniform orifice pitch;

ejection means for ejecting ink droplets through the plurality of orifices at an ink-ejection frequency onto a recording medium having a width in a widthwise direction and a length in a lengthwise direction perpendicular to the widthwise direction, wherein the line direction has an angle θ with respect to the lengthwise direction;

a pair of electrodes common to all the plurality of orifices and extending in the line direction while interposing the orifice line therebetween in plan view;

applying means for applying a voltage to the pair of electrodes, wherein the pair of electrodes generate a charging electric field and a deflecting electric field between the electrodes when applied with the voltage, the charging electric field having a magnitude that changes at the ink-ejection frequency and charging the ink droplets, the deflecting electric field having a constant magnitude and deflecting a flying direction of the ink droplets charged by the charging electric field; and controlling means for controlling the voltage applied to the electrodes such that the ink droplets deflected by the deflecting electric field impact on all grid corners of grids in a coordinate system defined on the recording medium, and that ink droplets ejected through a single one of the plurality of orifices and deflected by the deflecting electric field impact on one of n scanning lines extending in the lengthwise direction.

5. The multi-nozzle ink jet recording device according to claim 4, further comprising moving means that relatively moves the recording medium with respect to the orifices by a single-dot-worth of distance within a predetermined time duration in the lengthwise direction, wherein the ejection means ejects kx ink droplets in the predetermined time duration, and $n \geqq kx$.

6. The multi-nozzle ink jet recording device according to claim 5, wherein the grids in the coordinate system have a square shape with a squareness ratio r of 1, and n=kx.

7. The multi-nozzle ink jet recording device according to claim 5, wherein a value of tan θ is 1.

8. The multi-nozzle ink jet recording device according to claim 5, wherein the grids in the coordinate system have a rectangular shape with a squareness ratio r, and r=n.

9. The multi-nozzle ink jet recording device according to claim 8, n=kx.

10. The multi-nozzle ink jet recording device according to claim 9, wherein the ejection means performs a dispersed printing where a plurality of ink droplets ejected through a single one of the plurality of orifices impact on scanning lines that are separated one another by one or more scanning lines therebetween.

11. The multi-nozzle ink jet recording device according to claim 10, wherein the controlling means controls the voltage applied to the electrodes such that the ink droplets impact on a center of each of the grids in addition to the all grid corners.

12. The multi-nozzle ink jet recording device according to claim 11, wherein n>kx, and the ejection means ejects a plurality of selective ones of the ink droplets onto a single position on the recording medium so as to form a single dot.

13. The multi-nozzle ink jet recording device according to claim 12, wherein the controlling means controls the voltage applied to the electrodes such that the ink droplets impact on a center of each of the grids in addition to the all grid corners.

14. The multi-nozzle ink jet recording device according to claim 5, wherein a value of tan θ is ½, and the grids in the coordinate system have a rectangular shape with a squareness ratio r of 2.

15. The multi-nozzle ink jet recording device according to claim 5, wherein n is an integral number.

16. The multi-nozzle ink jet recording device according to claim 4, wherein the deflecting electric field deflects the ink droplets charged by the charging electric field toward a deflecting direction perpendicular to the line direction by an amount depending on a charging amount of the ink droplets charged by the charging electric field.

17. The multi-nozzle ink jet recording device according to claim 4, further comprising a plurality of the pairs of electrodes, wherein the print head includes a plurality of head units each formed with the orifice line, and the plurality of the pairs of electrodes are provided for corresponding ones of the head units.

18. A printing method using a multi-nozzle ink jet recording device including components that including: a print head formed with a orifice line extending in a line direction and including a plurality of orifices; ejection means for ejecting ink droplets through the plurality of orifices, the ink- droplets having a uniform shape and separated from one another; a pair of electrodes common to all the plurality of orifices; and generating means for generating a charging electric field and a deflecting electric field at the same time by applying a voltage to the pair of electrodes, the charging electric field being generated near the orifices and having a magnitude that changes at an ink-ejection frequency and charging the ink droplets, the deflecting electric field having a constant magnitude and deflecting a flying direction of the ink droplets, the method comprising the step of:

controlling the components to eject the ink droplets at a uniform ink-ejection frequency onto all grid corners of a rectangular coordinate system defined on a recording medium.

19. The printing method according to claim 18, wherein the ink droplets ejected through a single one of the plurality of orifices impact on a plurality of dispersed scanning lines.

20. The printing method according to claim 19, wherein a plurality ones of the ink droplets ejected through different ones of the plurality of orifices impact on a single position, thereby forming a single dot on the recording medium.

21. A printing method using a multi-nozzle ink jet recording device comprising components including: a print head formed with a orifice line extending in a line direction and including a plurality of orifices aligned at a uniform orifice pitch; ejection means for ejecting ink droplets through the plurality of orifices, the ink droplets having a uniform shape and separated from one another; a pair of electrodes common to all the plurality of orifices; and generating means for generating a charging electric field and a deflecting electric field at the same time by applying a voltage to the pair of electrodes, the charging electric field being generated near the orifices and having a magnitude that changes at an ink-ejection frequency and charging the ink droplets, the deflecting electric field having a constant magnitude and deflecting a flying direction of the ink droplets, the method comprising the step of:

controlling the components to eject the ink droplets at a uniform ink-ejection frequency onto all grid corners of a non-rectangular coordinate system defined on a honeycomb-shaped recording medium.

* * * * *

UNITED STATES PATENT AND TRADEMARK OFFICE

CERTIFICATE OF CORRECTION

PATENT NO. : 6,454,391 B1
DATED : September 24, 2002
INVENTOR(S) : Kobayashi et al.

It is certified that error appears in the above-identified patent and that said Letters Patent is hereby corrected as shown below:

Drawings,
Sheet 5, Fig. 8(b), the label "DEFLECTOR ELECTRIC FIELD E1" should read -- CHARGING ELECTRIC FIELD E1 --.

Column 4,
Line 18, the word "deflector" should be replaced with -- charging --.

Signed and Sealed this

Fourteenth Day of December, 2004

JON W. DUDAS
*Director of the United States Patent and Trademark Office*